US007961557B2

(12) United States Patent
Fujii et al.

(10) Patent No.: US 7,961,557 B2
(45) Date of Patent: Jun. 14, 2011

(54) ANALOG ELECTRONIC WATCH

(75) Inventors: Teruhiko Fujii, Sayama (JP); Isao Kitazawa, Shibuya-ku (JP); Masaaki Namekawa, Kiyose (JP); Takayuki Uchida, Tokorozawa (JP); Takayuki Hasumi, Niiza (JP); Takuji Ike, Nerima-ku (JP)

(73) Assignee: Citizen Holdings Co., Ltd., Tokyo (JP)

( * ) Notice: Subject to any disclaimer, the term of this patent is extended or adjusted under 35 U.S.C. 154(b) by 503 days.

(21) Appl. No.: 12/224,670

(22) PCT Filed: Mar. 2, 2007

(86) PCT No.: PCT/JP2007/053994

§ 371 (c)(1),
(2), (4) Date: Sep. 3, 2008

(87) PCT Pub. No.: WO2007/102412

PCT Pub. Date: Sep. 13, 2007

(65) Prior Publication Data

US 2009/0016172 A1 Jan. 15, 2009

(30) Foreign Application Priority Data

Mar. 3, 2006 (JP) ..... 2006-057589

(51) Int. Cl.
*G04B 19/04* (2006.01)
*G04B 19/06* (2006.01)
*G04B 47/06* (2006.01)

(52) U.S. Cl. ..... 368/80; 368/11

(58) Field of Classification Search ..... 368/11, 368/76, 80, 157, 160, 185, 187, 220
See application file for complete search history.

(56) References Cited

U.S. PATENT DOCUMENTS 4,420,263 A 12/1983 Besson et al.

(Continued)

FOREIGN PATENT DOCUMENTS

EP 1 662 343 5/2006

(Continued)

OTHER PUBLICATIONS

Supplementary European Search Report issued Apr. 7, 2010 in EP 07 73 7643.

(Continued)

*Primary Examiner* — Vit W Miska
(74) *Attorney, Agent, or Firm* — Wenderoth, Lind & Ponack L.L.P.

(57) ABSTRACT

An analog electronic watch of the present invention includes: a display unit (2) for displaying time with a position of a hand; a stepper motor (3) for driving the hand; a motor drive unit (4) for controlling driving of the stepper motor at a predetermined hand drive cycle at normal time; hand position detection means (5) for detecting a position of the hand; a hand position detection means control unit (6) for intermittently controlling driving of the hand position detection means (5) at a first detection cycle which is longer than the hand drive cycle; and a detection cycle changing unit (7) for instructing the hand position detection means (5) to change the detection cycle. When detecting a predetermined detection cycle changing condition, the detection cycle changing unit (7) changes a cycle at which the hand position detection means (5) detects a position of the hand, from the first detection cycle to a second detection cycle, while maintaining the hand drive cycle at which the stepper motor (3) drives the hand.

20 Claims, 17 Drawing Sheets

U.S. PATENT DOCUMENTS

| | | | | |
|---|---|---|---|---|
| 5,231,612 | A * | 7/1993 | Allgaier et al. | 368/47 |
| 5,270,993 | A * | 12/1993 | Besson et al. | 368/80 |
| 6,473,367 | B2 * | 10/2002 | Peng | 368/47 |
| 7,440,359 | B2 * | 10/2008 | Dinger | 368/80 |
| 2002/0095226 | A1 | 7/2002 | Suzuki et al. | |
| 2004/0120221 | A1 * | 6/2004 | Ogasawara et al. | 368/80 |
| 2006/0114750 | A1 | 6/2006 | Iida et al. | |
| 2007/0115760 | A1 | 5/2007 | Kitazawa et al. | |

FOREIGN PATENT DOCUMENTS

| | | |
|---|---|---|
| EP | 1 693 720 | 8/2006 |
| GB | 2 197 968 | 6/1988 |
| JP | 63-36478 | 7/1988 |
| JP | 2002-071846 | 12/2002 |
| JP | 2004-279033 | 10/2004 |
| JP | 2005-172677 | 6/2005 |
| JP | 2006-153652 | 6/2006 |
| WO | 2005/057298 | 6/2005 |

OTHER PUBLICATIONS

International Search Report issued Apr. 3, 2007 in the International (PCT) Application of which the present application is the U.S. National Stage.

* cited by examiner

ANALOG ELECTRONIC WATCH

TECHNICAL FIELD

The present invention relates to an analog electronic watch capable of automatically correcting a position displacement of a hand, even when the displayed time (a hand position) is displaced due to an influence such as a shock or external magnetism.

CLAIM OF PRIORITY

This application claims priority from Japanese Patent Application No. 2006-057589 filed on Mar. 3, 2006 in the Japanese Patent Office, the content of which is herein incorporated by reference in its entirety.

BACKGROUND ART

In an analog electronic watch such as a wrist watch, the present time can visually be checked with the rotational positions of an hour hand, a minute hand, and a second hand. When such an analog electronic watch undergoes, for example, a shock, a stepper motor which is an inner drive motor may rotate not at a constant step, but by multiple steps in either direction. As a result, the positions of the hands (a second hand, in particular) may be displaced from the position of reference time set in the watch.

For this reason, an electronic watch provided with an optical type hand position detection means has heretofore been proposed (e.g., refer to Patent Document 1). Such optical type hand position detection means detects whether a hand position is displaced when, for example, a shock is applied.

In an electronic watch described in Patent Document 1, an optical type hand position detection means is driven at a reference position (60 minutes in the embodiments), and at a position that is X steps short of the reference position (59 minutes or 59 minutes and 30 seconds, in the embodiments), and a detection value at the time is stored. Thereafter, the detection value thus stored is compared with a predetermined value representing a state where the hand passes the reference position without having a displacement. When the detection value is not equal to the predetermined value, it is determined to be abnormal (a hand position is displaced), and an electric motor (a stepper motor) is fast-forwarded. The detection operation is performed every X steps, and when the latest two values (the predetermined value and the detection value described above) match, the fast-forwarding operation of the electric motor (stepper motor) is stopped to be switched to a normal hand operation.

Patent Document 1: JP 63-36478B

DISCLOSURE OF THE INVENTION

Problems to be Solved by the Invention

When it is determined to be abnormal (a hand position is displaced), the hand position detection means of Patent Document 1 must continue fast-forwarding the electric motor (stepper motor) in a forward direction (in the clockwise direction) until finding the reference position. During this fast-forwarding detection process, the hand is fast-forwarded in the forward direction.

This operation on a hand that is suddenly performed seems so unnatural to a user that the user may feel a sense of uncertainty at the operation of the hand.

Further, since the hand position detection means of Patent Document 1 does not identify the direction in which the hand is displaced (forward direction or backward direction), the fast-forwarding can be performed only in the forward direction. As a consequence, compared with time necessary for a correction in the reverse direction, it may take long time to complete correction because the hand may need to be fast-forwarded more in the forward direction.

Moreover, the hand position detection means of Patent Document 1 performs the hand detection while fast-forwarding the electric motor (stepper motor). Therefore, considering an influence on the vibration of the rotor of the electric motor (stepper motor) and the degree of stability of an optical sensor, it is not possible to speed up the fast-forwarding of the electric motor (stepper motor) in order to perform a hand position detection with high accuracy.

In addition, factors causing a position displacement of the hand of the analog electronic watch include the above-described shock and external magnetism, ambient environment (humidity, temperature), ambient pressure (water pressure, atmospheric pressure), heavy load, ambient brightness if a solar cell is included as a power source, and a state of overcharge. However, the invention described in Patent Document 1 does not include a sensor capable of detecting such factors of a hand position displacement. As a result, it takes a long time to detect a hand position displacement from the occurrence of any of the above factors.

To address the above problems, an object of the invention is to provide an analog electronic watch capable of detecting a hand position displacement in a normal and natural movement of a hand. In addition, another object of the invention is to provide an analog electronic watch capable of efficiently correcting the displacement of a hand position in a short time.

A further object of the invention is to provide an analog electronic watch capable of performing a hand position detection with high accuracy without performing of a hand position detection at the time of fast-forwarding a hand. Yet another object of the invention is to provide an analog electronic watch capable of detecting factors of hand position displacements and thus of detecting a hand position displacement immediately when a factor causing the hand position displacement occurs.

Means for Solving the Problems

To achieve the above-described objects, a first aspect of the present invention is an analog electronic watch including: display means for displaying time with a position of a hand being driven; hand drive means for driving the hand; hand drive means control unit for controlling driving of the hand drive means at a predetermined hand drive cycle in a normal state; hand position detection means for detecting a position of the hand; and a hand position detection means control unit for intermittently controlling driving of the hand position detection means at a first detection cycle longer than the hand drive cycle. The analog electronic watch further includes detection cycle changing means for instructing the hand position detection means control unit to change a detection cycle of the hand position detection means. Further, in the analog electronic watch, upon detection of a predetermined detection cycle changing condition, the detection cycle changing means changes a cycle at which the hand drive means detects a position of the hand, from the first detection cycle to a second detection cycle, while maintaining the hand drive cycle at which the hand drive means drives the hand.

A second aspect of the present invention is that the second detection cycle is shorter than the first detection cycle.

A third aspect of the present invention is that the second detection cycle is the same as the hand drive cycle.

A fourth aspect of the present invention is that the analog electronic watch includes: a counter for counting every time the hand drive means drives the hand, the counter being reset for each performing of a hand position detection before the detection cycle is changed to the second detection cycle, and continuing counting until a hand position is successfully detected after the detection cycle is changed from the first detection cycle to the second detection cycle; and a hand position correction amount calculation means for calculating a difference between the first detection cycle and a count value of the counter at the time when a hand position is successfully detected after the detection cycle is changed from the first detection cycle to the second detection cycle, for determining a correction condition of a hand position, based on the difference thus calculated, and for notifying the hand drive means control unit of the correction condition.

A fifth aspect of the present invention is that the detection cycle changing condition is a failure of a hand position detection performed before the detection cycle is changed from the first detection cycle to the second detection cycle.

A sixth aspect of the present invention is that the hand drive means is capable of driving the hand at a cycle faster than the hand drive cycle in either of the forward and reverse directions of the hand. Further, the hand drive means control unit performs a correction of the hand position by driving the hand in either of forward and reverse hand directions at the faster cycle.

A seventh aspect of the present invention is that the detection cycle changing means changes the detection cycle from the second detection cycle back to the first detection cycle in response to a correction termination instruction from the hand drive means control unit.

An eighth aspect of the present invention is that the hand is a second hand, and that the first detection cycle is 60 seconds.

A ninth aspect of the present invention is that the analog electronic watch further includes a hand position displacement factor detection means for detecting a factor causing a hand position displacement in which a position of the hand and a time measured by internal time timing means do not match with each other, and for outputting a detection signal to the detection cycle changing means when detecting a factor causing a hand position displacement. Further, in the analog electronic watch, the detection signal is the detection cycle changing condition.

A tenth aspect of the present invention is that the hand position displacement factor detection means is a shock detection means which, upon detection of a shock, outputs a shock detection signal to the detection cycle changing means.

An eleventh aspect of the present invention is that the hand drive means is a stepper motor, and that the shock detection means outputs a shock detection signal to the detection cycle changing means when detecting a counter-electromotive force generated in the stepper motor due to a shock externally applied.

A twelfth aspect of the present invention is that the shock detection means is a combination of a piezoelectric device and piezoelectric device drive means for driving the piezoelectric device, and that the piezoelectric device drive means outputs a shock detection signal to the detection cycle changing means upon detection of a counter-electromotive force generated in the piezoelectric device due to a shock externally applied.

A thirteenth aspect of the present invention is that the hand position displacement factor detection means is external magnetism detection means which detects magnetism externally applied, and outputs a magnetism detection signal to the detection cycle changing means when detecting the magnetism.

A fourteenth aspect of the present invention is that the hand drive means is a stepper motor, and that the hand position displacement factor detection means is stepper motor rotation detection means which detects whether the stepper motor is in rotation or not, by detecting a magnetic field generated due to the rotation of the rotor of the stepper motor. Further, the stepper motor rotation detection means also functions as the external magnetism detection means by detecting a magnetic field generated in the stepper motor at the time of generation of external magnetism.

A fifteenth aspect of the present invention is that the hand position displacement factor detection means is a temperature detection means which detects ambient temperature, and which outputs a temperature detection signal to the detection cycle changing means when detecting the ambient temperature.

A sixteenth aspect of the present invention is that rate correction means which corrects a rate according to a temperature also functions as the temperature detection means.

A seventeenth aspect of the present invention is that the hand position displacement factor detection means is light detection means which detects ambient brightness, and which outputs a light detection signal to the detection cycle changing means when detecting the ambient brightness.

An eighteenth aspect of the present invention is that a power source as a source of power includes photoelectric conversion means and power storage means for storing electric power generated by the photoelectric conversion means, and that the light detection means detects the brightness of light received by the photoelectric conversion means.

A nineteenth aspect of the present invention is that the hand position displacement factor detection means is power source voltage detection means which detects a power source voltage of a power source as a source of power. When the value of the power source voltage detected by the power source voltage detection means is equal to or higher than a predetermined voltage, a high voltage detection signal is outputted to the detection cycle changing means.

A twentieth aspect of the present invention is that the hand position displacement factor detection means is pressure detection means which detects pressure applied on the analog electronic watch. When the value of the pressure detected by the pressure detection means is equal to or higher than predetermined pressure, a high pressure detection signal is outputted to the detection cycle changing means.

A twenty-first aspect of the present invention is that the hand drive means is a stepper motor, and that the hand position displacement factor detection means is stepper motor rotation detection means which detects whether the stepper motor is in rotation or not, and which includes a counter for counting when the stepper motor is determined not to be in rotation. Further, when a count value of the counter is equal to or higher than a predetermined value, a detection signal is outputted to the detection cycle changing means.

A twenty-second aspect of the present invention is that the analog electronic includes, as the hand position displacement factor detection means, an external operation member, and an operation signal output which outputs an operation signal to the detection cycle changing means when the external operation member is operated.

A twenty-third aspect of the present invention is that the analog electronic watch includes power source voltage detection means for detecting a power source voltage of a power source as a source of power. In the analog electronic watch, when the power source voltage detection means detects that a voltage of the power source voltage is reduced to a value equal to or lower than a predetermined voltage, the hand position detection means is driven so as to consume a power lower than that consumed when the voltage is equal to or higher than the predetermined voltage.

A twenty-fourth aspect of the present invention is that the hand position detection means is a transparent type hand position detection sensor in which light is emitted from a light emitting device and is received through a detection hole by a light receiving device. When the power source voltage detection means detects that the power source voltage is reduced to a value equal to or lower than the predetermined voltage, a light emitting time period of the light emitting device is made shorter than that at normal time, and a light receiving time period of the light receiving device is made shorter than that at normal time.

A twenty-fifth aspect of the present invention is that while the power source voltage is reduced to a value equal to or lower than the predetermined voltage, when the hand position detection means detects a hand position abnormality by detecting a hand position in a state where the light emitting time period of the light emitting device is shortened, a hand position detection process is performed with the detection cycle changed, and when the detection of a hand displacement is unsuccessful, a subsequent hand position detection process is suspended.

Effect of the Invention

According to the invention, upon detection of a predetermined detection cycle changing condition, a cycle at which the hand position detection means detects a hand position is changed from the first detection cycle to the second detection cycle while maintaining a hand drive cycle of the stepper motor for a hand. Accordingly, detection of displacement of the hand position can be performed in a natural and normal movement of the hand.

Further, a hand detection is not performed while fast-forwarding the stepper motor driving hands, unlike before. Accordingly, the detection of the hand position displacement can be performed while preventing an influence such as a vibration of the stepper motor.

Depending on a displaced position of a hand, the hand is fast-forwarded in a forward direction or in a reverse direction. Accordingly, a position displacement correction can be performed efficiently in a short time, and lower power consumption of the stepper motor can be achieved.

DESCRIPTION OF SYMBOLS

1 TO 1H ANALOG ELECTRONIC WATCH
2 DISPLAY UNIT
2*c* SECOND HAND
3 STEPPER MOTOR
4 MOTOR DRIVE UNIT
5 HAND POSITION DETECTION MEANS
6 HAND POSITION DETECTION MEANS CONTROL UNIT
7 DETECTION CYCLE CHANGING UNIT
8 CORRECTION AMOUNT CALCULATION UNIT
8*a* TIMER COUNTER
8*b* HAND DETECTION COUNTER
8*c* HAND POSITION COUNTER
9 TIMER UNIT
10 SHOCK DETECTOR
11 EXTERNAL MAGNETISM DETECTOR
12 TEMPERATURE DETECTOR
13 LIGHT DETECTOR
14 POWER VOLTAGE DETECTOR
15 SOLAR CELL
16 SECONDARY BATTERY
17 PRESSURE DETECTOR
18 STEPPER MOTOR ROTATION DETECTOR

18*a* COUNTER UNIT
19 EXTERNAL OPERATION BUTTON
20 OPERATION SIGNAL OUTPUT UNIT
21 POWER SOURCE
22 POWER SOURCE VOLTAGE DETECTOR
30 LIGHT EMITTING UNIT
31 LIGHT RECEIVING UNIT
33 FIRST COMPARATOR
35 LED
37 PHOTOTRANSISTOR
38 SECOND COMPARATOR
42 THIRD COMPARATOR
45 CONSTANT-VOLTAGE CIRCUIT

BEST MODES FOR CARRYING OUT THE INVENTION

The invention is described with reference to embodiments shown in the accompanying drawings.

Embodiment 1

Figure 1:
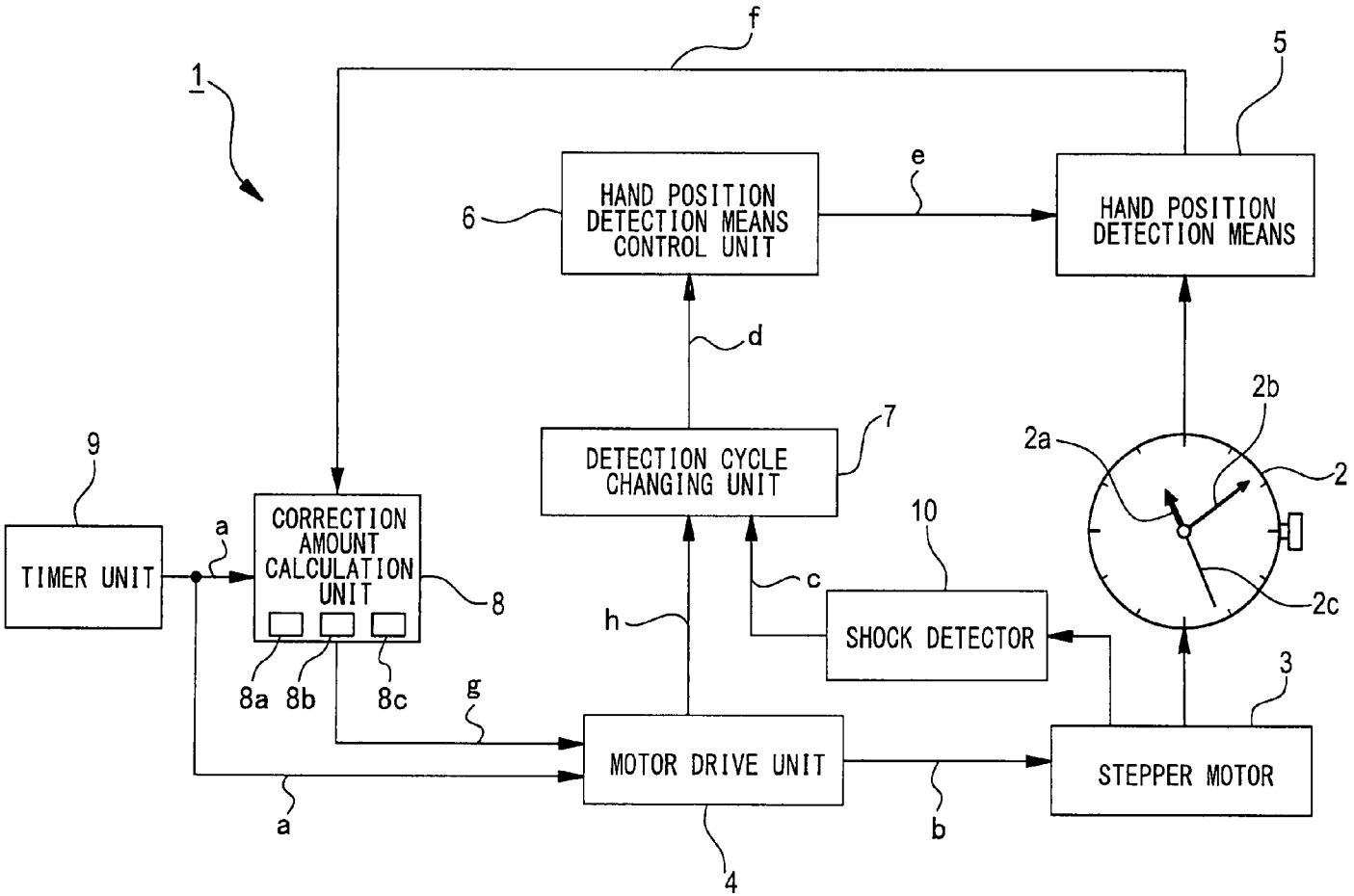
FIG. 1 is a block diagram showing a configuration of an analog electronic watch of Embodiment 1 of the invention.

FIG. 1 is a block diagram showing a configuration of an analog electronic watch of Embodiment 1 of the invention. Note that an analog electronic watch in this embodiment is an example of an analog electronic wrist watch.

As shown in FIG. 1, an analog electronic watch (an analog electronic wrist watch) 1 of this embodiment includes a display unit 2 provided with hands, a stepper motor 3 serving as a hand drive means, a motor drive unit 4 serving as a hand drive means control unit, hand position detection means 5, hand position detection means control unit 6, detection cycle changing unit 7, a correction amount calculation unit 8 serving as a hand position correction amount calculation means, a timer unit 9, and a shock detector 10 serving as a hand position displacement factor detection means.

The rotation of the stepper motor 3 is controlled based on a drive pulse signal outputted from the motor drive unit 4 so as to drive hands of the display unit 2 via a gear train (not shown). Incidentally, in this embodiment, an hour hand 2*a*, a minute hand 2*b*, and a second hand 2*c* are provided as hands.

In this embodiment, the hand position detection means 5 detects a hand position of the second hand 2*c*. For example, the hand position detection means 5 detects a 0 second position (a position at twelve o'clock on the display unit 2) of the second hand 2*c*, based on whether a known transparent type hand position detection sensor detects light transmission or not. In the transparent type hand position detection sensor serving as the hand position detection means 5, a movable member is provided between a light emitting element such as an LED and a light receiving element such as a phototransistor, which face each other, and moves in conjunction with the rotation of a hand (second hand 2*c*). When a light beam emitted from the light emitting element passes through a detection hole formed in the movable member, and is then received by the light receiving element, it is determined that the hand (second hand 2*c*) is at a normal poison.

As just described, when a light beam emitted from a light emitting element passes through the detection hole and is thus detected at a light receiving element at the 0 second position, it is determined that the second hand 2*c* is at the normal position or that the detection has been successful. On the other hand, when the light cannot be detected, it is determined that the detection has been unsuccessful. This embodiment is made in accordance with this configuration. Note that other known detection methods can be employed instead of the above-described method, including, for example, a reflection type light sensor, a magnetic sensor, and a mechanical type detection device.

Based on a detection cycle changing instruction signal from the detection cycle changing unit 7, the hand position detection means control unit 6 controls a detection cycle at which the hand position detection means 5 detects a hand position. Here, the detection cycle can be switched between a first detection cycle and a second detection cycle (detailed described will be given later).

The correction amount calculation unit 8 compares a reference time signal inputted from the timer unit 9 with information on hand position detection result inputted from the hand position detection means 5. When determining that the hand position is displaced relative to the reference time (60 seconds during which the second hand 2*c* makes one rotation from the position of 12 o'clock), the correction amount calculation unit 8 calculates an amount of correction for the displacement (detailed described will be given later). Further, the correction amount calculation unit 8 includes a timer counter 8*a*, a hand detection counter 8*b*, and a hand position counter 8*c*, the description of which will be given later.

The shock detector 10 detects whether any external shock has been applied on the analog electronic watch 1. In this embodiment, the shock detector 10 is configured to detect the application of a shock on the analog electronic watch 1, based on a counter-electromotive force generated in a rotor of the stepper motor 3 which moves the hands (the hour hand 2*a*, the minute hand 2*b*, and the second hand 2*c*), the counter-electromotive force being generated when the rotor swings due to the shock. Note that Japanese Patent Application Publication No. 2005-172677 describes a configuration for detecting a shock on an analog electronic watch based on the counter-electromotive force generated in the stepper motor, and this configuration may be used, for example.

Next, with reference to a flowchart shown in FIG. 2, description will be given of operation of detecting a displacement of a hand position of the analog electronic watch 1 due to a shock and operation of correcting the displacement. Incidentally, an example in this embodiment is on the operation of detecting a position displacement of the second hand 2*c* and of correcting the position displacement thereof.

In response to a reference time signal a inputted from the timer unit 9, the motor drive unit 4 outputs a normal drive pulse signal b to the stepper motor 3. The stepper motor 3 is thus rotated to drive the second hand 2*c* normally (1 second interval movement) (Step S1).

At this time, the shock detector 10 is in a state capable of detecting whether or not a shock has been applied on the analog electronic watch 1, based on a presence of a counter-electromotive force generated in the stepper motor 3 (Step S2). At a normal time when a shock is not detected, that is, when a counter-electromotive force is not generated in the stepper motor 3 (Step S2: NO), the hand position detection means 5 performs detection of a hand position once every 60 seconds (60 second cycle), which is a normal first detection cycle (Step 3).

Further, if the second hand 2*c* is determined to be in a normal state in which the position of the second hand 2*c* is correctly placed at the 0 second position, while the hand position detection means 5 performs the detection of a hand position once every 60 seconds (Step S4: YES), operation of correcting displacement of a hand position does not need to be performed, so that the process is terminated. On the other hand, in Step S4, when an abnormality is determined to have occurred in which the second hand 2*c* is not placed at the 0 second position due to other factors of displacement of a hand position (such as an external magnetism), while the hand position detection means 5 performs the detection of a hand position once every 60 seconds (Step S4: NO), the detection cycle is changed from the first detection cycle (once every 60 seconds) to a cycle of once every second (one second cycle), which is the second detection cycle, to perform detection of a hand position every second (Step S5).

Incidentally, in Step S2, when an external shock is applied on the analog electronic watch 1 because, for example, the analog electronic watch 1 is dropped or struck against any object, the shock detector 10 detects the external shock applied on the analog electronic watch 1, based on a counter-electromotive force generated in the stepper motor 3 (Step S2: YES). At this time, the shock detector 10 outputs a shock detection signal c to the detection cycle changing unit 7.

Also when a shock is detected by the shock detector 10, the process moves to Step S5, and the detection cycle is changed from the first detection cycle (once every 60 seconds) to the cycle of once every second (one second cycle), which is the second detection cycle, to perform detection of a hand position every second. Note that, when the detection cycle is changed from the first detection cycle (once every 60 seconds) to the second detection cycle (one second cycle) in Step 5, the second hand 2*c* is still driven at a normal hand drive cycle (one second interval movement) which is the same as the second detection cycle (one second cycle).

In response to a cycle change instruction signal d from the detection cycle changing unit 7, the hand position detection means control unit 6 outputs a hand position detection instruction signal e to the hand position detection means 5. In response to this, the hand position detection means 5 performs hand position detection every second (Step S6). Thereafter, when the hand position detection means 5 detects an original detection position (the 0 second position in this embodiment) by performing hand position detection for every second (Step S7: YES), the hand position detection means 5 outputs position displacement detection result data f to the correction amount calculation unit 8. Then, the correction amount calculation unit 8 calculates an amount of correction of the position displacement of the hand, based on the position displacement detection result data f and the reference time signal a inputted from the timer unit 9 (Step S8).

Thereafter, the correction amount calculation unit 8 outputs correction amount data g of the position displacement to the motor drive unit 4. Based on the correction amount data g, the motor drive unit 4 controls the rotation of the stepper motor 3 to correct the displacement by fast-forwarding the hand (second hand 2*c*) (Step S9). On the other hand, when detection of the 0 second position of a hand is unsuccessful in Step S7 (Step S7: NO), the process returns to Step S6 to repeat detection of a hand position for every second. Operation of specific examples of Steps S8 and S9 are described later.

When a position displacement correction of a hand is terminated in Step S9 (Step S10: YES), the drive cycle of the second hand 2*c* is changed to a usual hand drive cycle (one second interval movement) (Step S11). When the position displacement correction of a hand is not terminated in Step 10 (Step S10: NO), the process returns to Step S9.

Then, the motor drive unit 4 outputs a detection cycle restoration instruction signal h to the detection cycle changing unit 7. In response to this, the detection cycle changing unit 7 outputs a cycle change instruction signal d to the hand position detection means control unit 6. In response to the hand position detection instruction signal e inputted from the hand position detection means control unit 6, the hand position detection means 5 changes the detection cycle from 1 second to 60 seconds to return the detection cycle to the usual 60 seconds cycle (Step S12), and performs hand position detection.

Incidentally, even when the shock detector 10 detects that an external shock has applied on the analog electronic watch 1 in Step S2, the position of the hand (second hand 2*c*) may not be displaced depending on the magnitude of a shock. That is, this is the case where, in Step S6, the hand position detection means 5 succeeds in detecting the hand position at the 0 second position while performing hand position detection for every second. In this case, the detection cycle is changed from 1 second to 60 seconds to perform a usual hand position detection without making any correction to the hand position.

Figure 2:
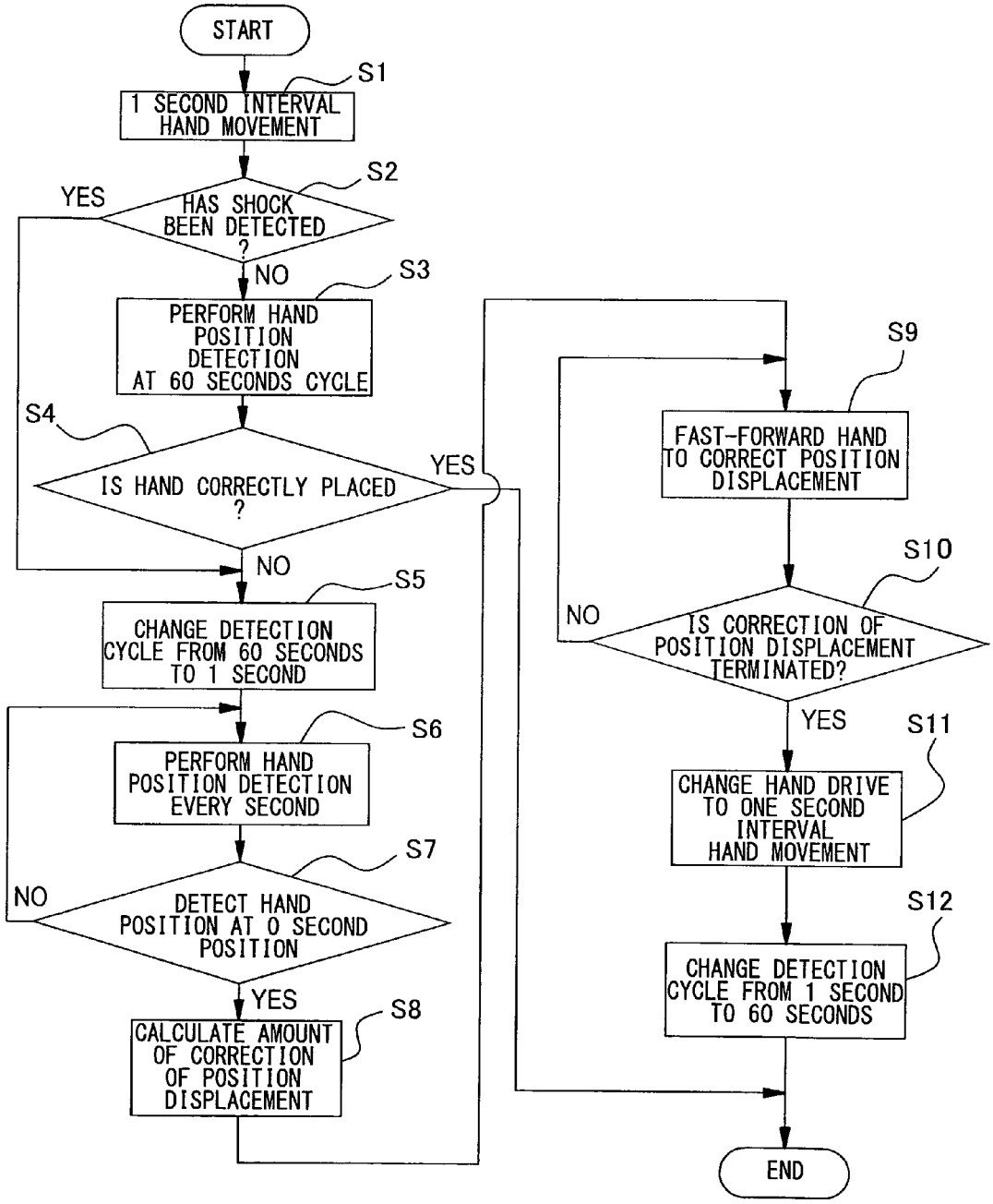
FIG. 2 is a flowchart showing operation of detecting a displacement of a hand position of an analog electronic watch of Embodiment 1 of the invention due to a shock applied thereon, and of correcting the displacement of the hand position.
Figure 3:
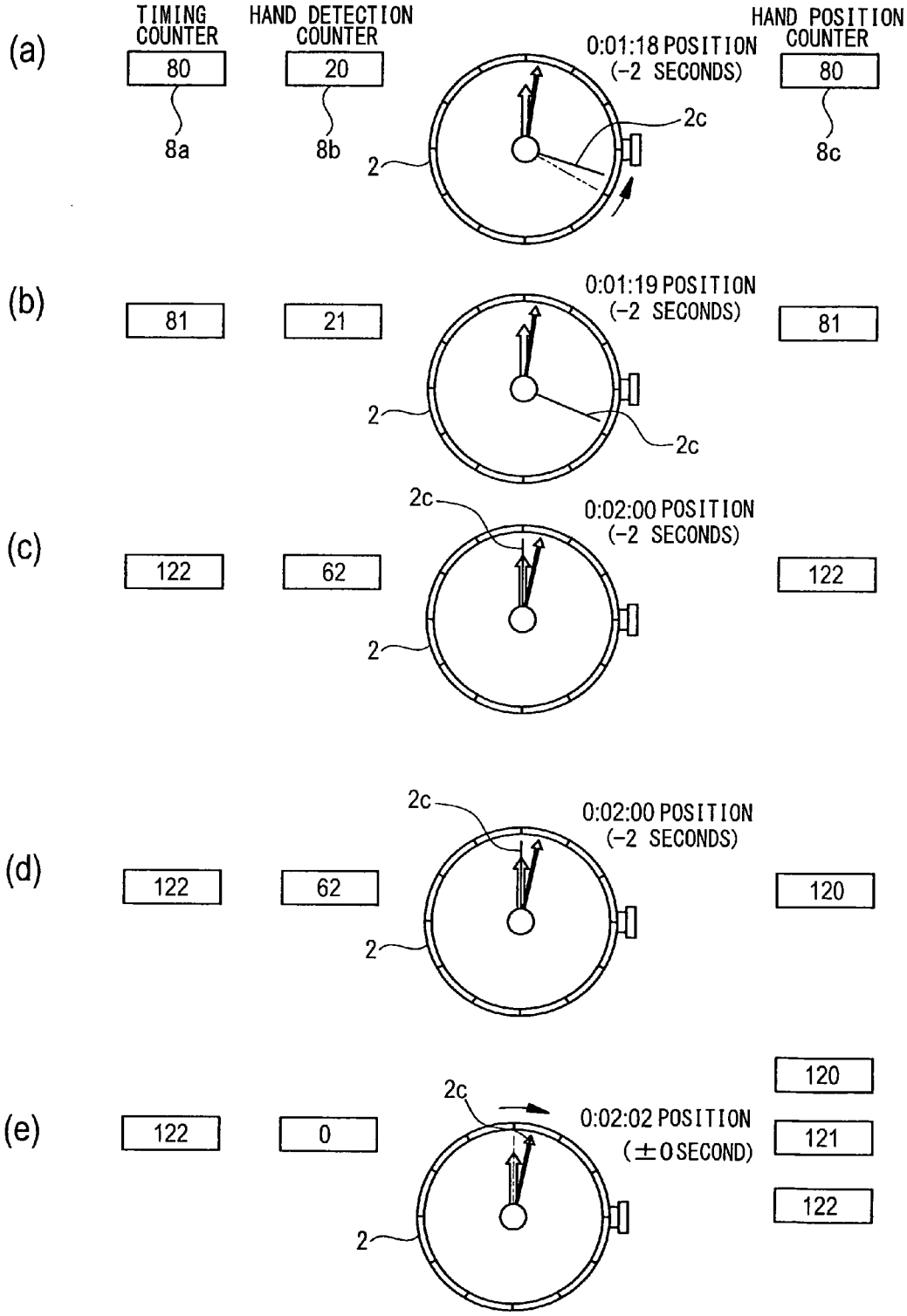
FIGS. 3(*a*) to 3(*e*) show operation of detecting a displacement of a hand position and of correcting the displacement of the hand position in a state in which a second hand is 2 seconds behind regular time due to a shock externally applied.
Figure 4:
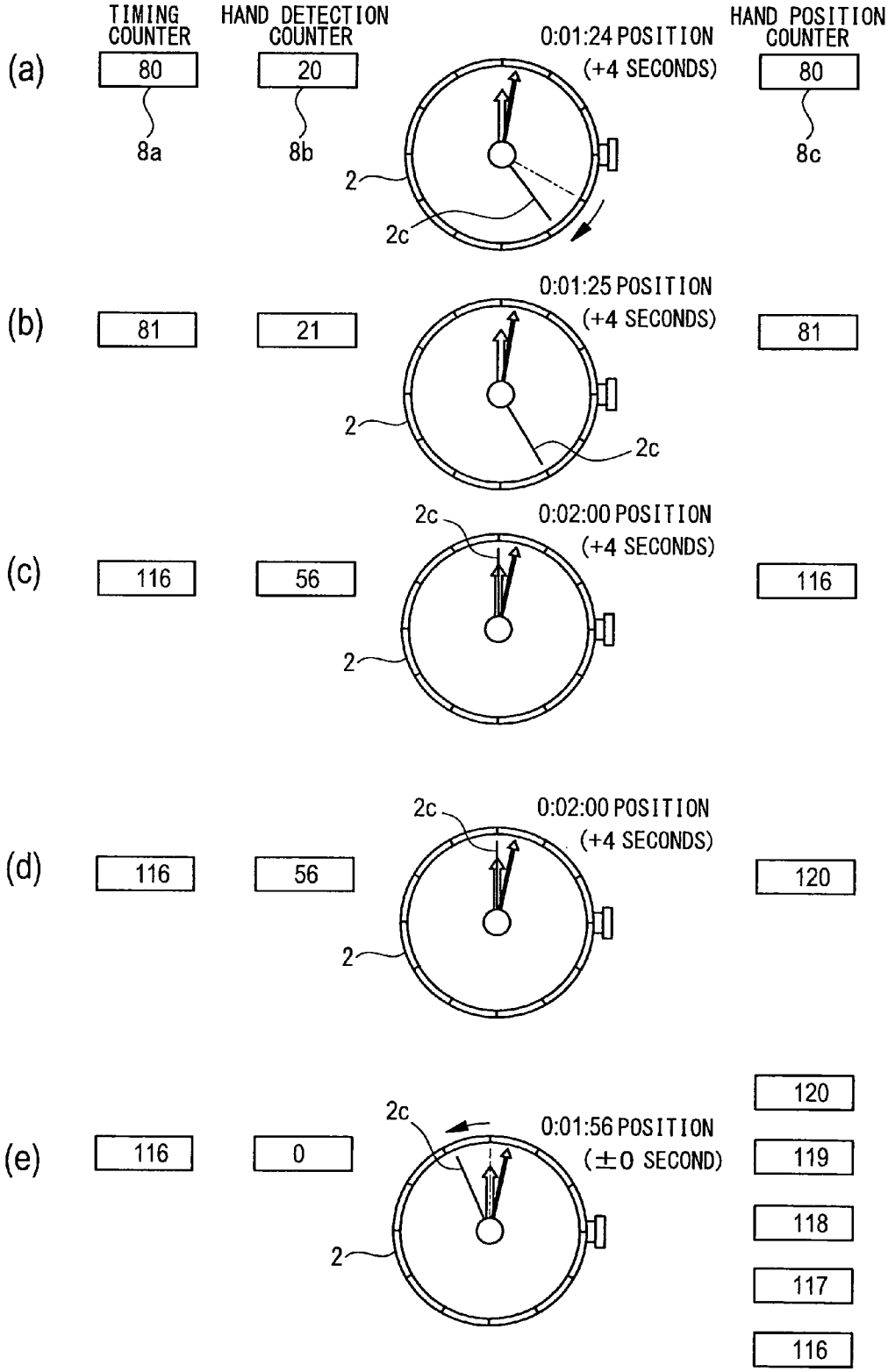
FIGS. 4(*a*) to 4(*e*) show operation of detecting a displacement of a hand position and of correcting the displacement of the hand position in a state in which a second hand is 4 seconds ahead of regular time due to a shock externally applied.

Next, referring to FIGS. 3(*a*) to 3(*e*) and FIGS. 4(*a*) to 4(*e*), operation of specific examples of Steps S8 and S9 of the flowchart shown in FIG. 2 is described. FIGS. 3(*a*) to 3(*e*) show a state in which an external shock is applied on the second hand 2*c* of the display unit 2 when the second hand 2*c* is at the position at 20 seconds, so that the second hand 2*c* is 2 seconds behind. FIGS. 4(*a*) to 4(*e*) show a state in which an external shock is applied on the second hand 2*c* of the display unit 2 when the second hand 2*c* is on the position at 20 seconds, so that the second hand 2*c* is 4 seconds ahead.

[In the Case Where the Second Hand 2*c* is 2 Seconds behind Regular Time Due to a Shock]

FIG. 3(*a*) shows a state in which a shock is applied on the analog electronic watch (analog electronic wrist watch) 1 at the time of 0:01:20 (1 minute 20 seconds after midnight), so that the time is delayed by 2 seconds (−2 seconds) to 0:01:18 (1 minute 18 seconds after midnight). In FIG. 3(*a*), the timer counter 8*a*, the hand detection counter 8*b*, and the hand position counter 8*c* included in the correction amount calculation unit 8 indicate "80," "20," and "80," respectively.

The timer counter 8*a* counts a value corresponding to time, the value being outputted from the timer unit 9 to the correction amount calculation unit 8. In FIG. 3 (*a*), the timer counter 8*a* indicates "80" which corresponds to 0:01:20 (1 minute 20 seconds after midnight). The hand detection counter 8*b* is reset every time hand position detection is performed, and counts every drive pulse signal given by the stepper motor 3. In FIG. 3 (*a*), the hand detection counter 8*b* indicates "20" which corresponds to the position of the second hand 2*c* at 20 seconds. In addition, after the detection cycle is changed to one second detection cycle (the second detection cycle), the hand detection counter 8*b* keeps on counting until hand detection is successfully performed. The hand position counter 8*c* usually indicates the same count value as the timer counter 8*a*. When hand detection for every second is performed successfully, the hand position counter 8*c* indicates a count value which corresponds to an amount of correction of a position displacement detected.

When a counter-electromotive force in the stepper motor 3 is detected by the shock detector 10, thereby detecting the application of a shock on the analog electronic watch (analog electronic wrist watch) 1, hand position detection for every second (one second cycle) is started from 0:01:19 (time information from the timer unit 9 is 0:01:21) of the display unit 2 shown in FIG. 3(*b*). Here, in FIG. 3(*b*), the timer counter 8*a* indicates "81," the hand detection counter 8*b* "21," and the hand position counter 8*c* "81."

At 0:02:00 (time information from the timer unit 9 is 0:02:02) of the display unit 2 shown in FIG. 3(*c*), the hand position detection is successfully performed. Here, in FIG. 3(*c*), the timer counter 8*a* indicates "122," the hand detection counter 8*b* "62," and the hand position counter 8*c* "122." Using a hand position detection value at this time, a difference between the first detection cycle (60 seconds) and the count value ("62") of the hand detection counter 8*b* (60−62=−2) is calculated. Based on this calculation result, the correction amount calculation unit 8 determines that the time is 2 seconds behind.

Thereafter, in FIG. 3(*d*), based on the 2-second delay thus calculated, a count value of the hand position counter 8*c* is changed to 120 (=122−2). In FIG. 3(*e*), since the timer counter 8*a* indicates "122" and the hand position counter 8*c* indicates "120," the count value of the hand position counter 8*c* is increased by a count value corresponding to an amount of correction (122−120=+2). The hand position counter 8*c* is thereby set to "122." Then, the motor drive unit 4 outputs a drive pulse signal corresponding to the amount of correction to the stepper motor 3, so as to move, while fast-forwarding, the second hand 2*c* to the count value of the timer counter 8*a* "122" in a forward direction. Note that a drive cycle while fast-forwarding is faster than a usual hand drive cycle (1 second interval movement).

As a result, in FIG. 3(*e*), the timer counter 8*a* indicates "122," the hand position counter 8*c* indicates "122," and the hand detection counter 8*b* is reset to indicate "0."

Upon termination of the correction of the position displacement of the hand (second hand 2*c*), the interval of the hand drive is changed to the one second interval movement, and, further, the hand position detection cycle is changed from 1 second to 60 seconds so as to be returned to a usual hand movement state.

[In the Case Where the Second Hand 2*c* is 4 Seconds ahead of Regular Time Due to a Shock]

FIG. 4(*a*) shows a state in which a shock is applied on the analog electronic watch (analog electronic wrist watch) 1 at the time of 0:01:20 (1 minute 20 seconds after midnight), so that the time is forwarded by 4 seconds (+4 seconds) to 0:01:24 (1 minute 24 seconds after midnight). In FIG. 4(*a*), the timer counter 8*a*, the hand detection counter 8*b*, and the hand position counter 8*c*, which are included in the correction amount calculation unit 8, indicate "80," "20," and "80," respectively.

When a counter-electromotive force in the stepper motor 3 is detected by the shock detector 10, thereby detecting the application of a shock on the analog electronic watch (analog electronic wrist watch) 1, a hand position detection for every second (one second cycle) is started from 0:01:25 (time information from the timer unit 9 is 0:01:21) of the display unit 2 shown in FIG. 4(*b*). Incidentally, in FIG. 4(*b*), the timer counter 8*a* indicates "81," the hand detection counter 8*b* "21," and the hand position counter 8*c* "81."

At 0:02:00 (time information from the timer unit 9 is 0:01:56) of the display unit 2 shown in FIG. 4(*c*), the hand position detection is successfully performed. In FIG. 4(*c*), the timer counter 8*a* indicates "166," the hand detection counter 8*b* "56," and the hand position counter 8*c* "116." Using a hand position detection value at this time, a difference between the first detection cycle (60 seconds) and the count value of the hand detection counter 8*b* ("56") (60−56=+4) is calculated. Based on this calculation result, the correction amount calculation unit 8 determines that the time is 4 seconds ahead.

Thereafter, in FIG. 4(*d*), based on the determination that the second hand 2*c* is 4 seconds ahead, a count value of the hand position counter 8*c* is changed to 120 (=116+4). Then, in FIG. 4(*e*), since the timer counter 8*a* indicates "116" and the hand position counter 8*c* indicates "120," the count value of the hand position counter 8*c* is reduced by a count value corresponding to an amount of correction (116−120=−4), so that the hand position counter 8*c* is set to "116." Then, the motor drive unit 4 outputs a drive pulse signal corresponding to the amount of correction to the stepper motor 3, so as to move, while fast-forwarding, the second hand 2*c* to the count value of the timer counter 8*a* "116" in a reverse direction.

As a result, in FIG. 4(*e*), the timer counter 8*a* indicates "116," the hand position counter 8*c* "116," and the hand detection counter 8*b* is reset to indicate "0."

Upon termination of the correction of the position displacement of the hand (second hand 2*c*), the hand drive is changed to the one second interval movement, and, further, the hand position detection cycle is changed from 1 second to 60 seconds so as to be returned to a usual hand movement state.

Meanwhile, in the flowchart shown in FIG. 2, when a shock is not detected in Step S2 (Step S2: NO) and when hand position detection is performed at a 60 second cycle (Step S3), it may be determined that a hand position is displaced due to an influence of an eternal magnetism (Step S4: NO). In this case, also, the detection cycle is changed from 1 second (1 second cycle) to 60 seconds so as to perform a hand position detection every second (Step S5).

Figure 5:
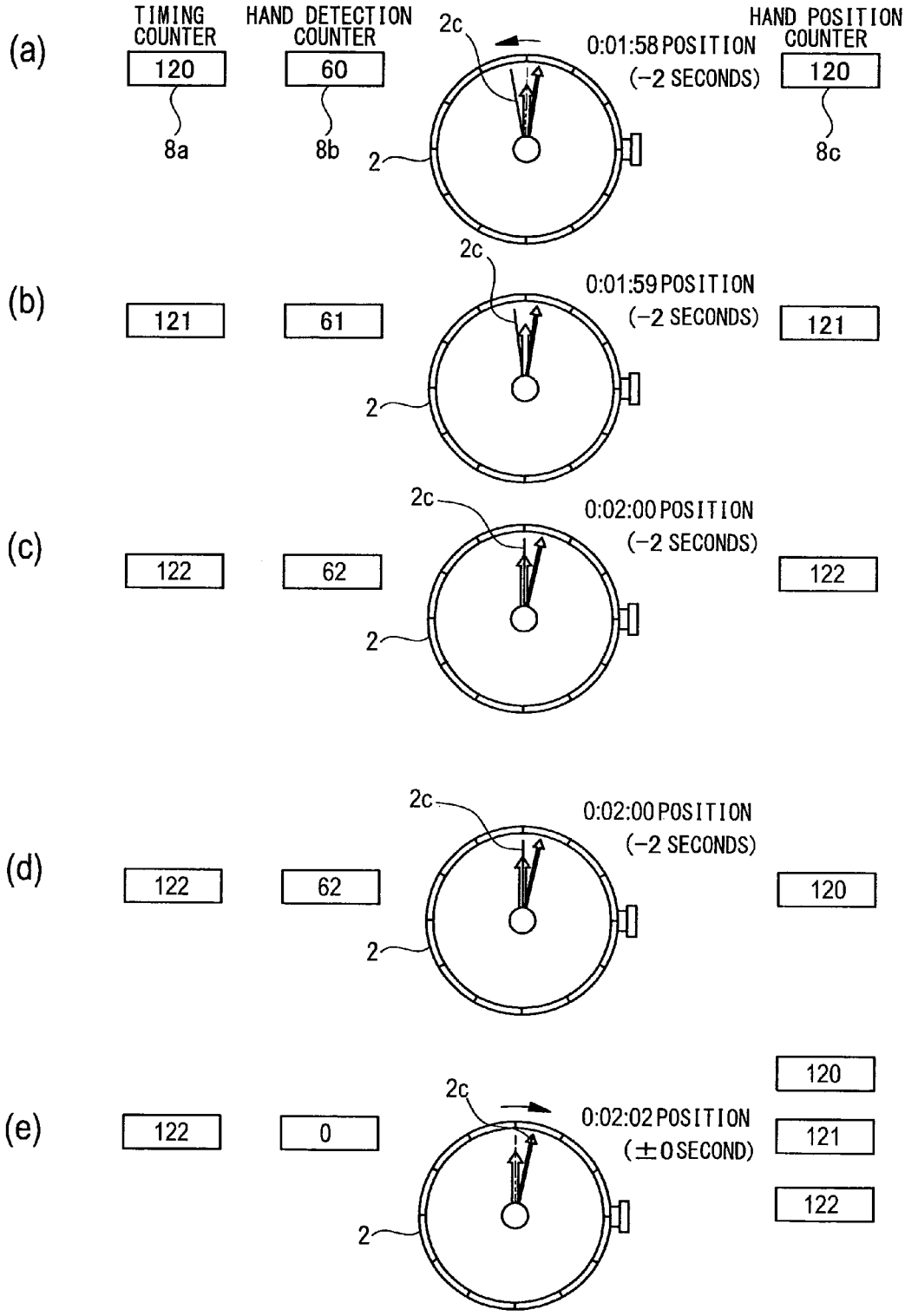
FIGS. 5(*a*) to 5(*e*) show operation of detecting a displacement of a hand position and of correcting the displacement of the hand position in a state in which a second hand is 2 seconds behind regular time due to a shock externally applied.

Referring to FIGS. 5(*a*) to 5(*e*), description will be given below of operation of detecting a displacement of a hand position of the second hand 2*c* and correcting the displacement when the hand position is displaced due to magnetism, so that the second hand 2*c* of the display unit 2 is 2 seconds behind at the 0 second position.

[In the case where the second hand 2*c* is 2 seconds behind due to magnetism]

FIG. 5(*a*) shows a state in which the analog electronic watch (analog electronic wrist watch) 1 indicates 0:01:58 (1 minute 58 seconds after midnight) since an external magnetism has been applied on the analog electronic watch 1 at 0:02:00 (2 minutes 0 second after midnight), thereby causing a 2 second delay (−2 seconds). In FIG. 5(*a*), the timer counter 8*a*, the hand detection counter 8*b*, and the hand position counter 8*c*, which are included in the correction amount calculation unit 8, indicate "120," "60," and "60," respectively. Note that the hand detection counter 8*b* keeps on counting without making a reset at 60 seconds (at the 0 position).

In a state shown in FIG. 5(*a*), since the second hand 2*c* is 2 seconds behind, a hand position detection of the second hand 2*c* at the 0 second position is unsuccessfully performed in the usual 60 second cycle. Due to the unsuccessful hand position detection, hand position detection is started from 0:01:59 (time information is 0:02:01) of the display unit 2 shown in FIG. 5(*b*) with a cycle change to every second (one second cycle). In FIG. 5(*b*), the timer counter 8*a* indicates "121," the hand detection counter 8*b* "61," and the hand position counter 8*c* "121."

At 0:02:00 (time information from the timer unit 9 is 0:02:02) of the display unit 2 shown in FIG. 5(*c*), the hand position detection is successfully performed. At this time, in FIG. 5(*c*), the timer counter 8*a* indicates "122," the hand detection counter 8*b* "62," and the hand position counter 8*c* "122." Using a hand position detection value at this time, a difference between the first detection cycle (60 seconds) and the count value of the hand detection counter 8*b* ("62") (60−62=−2) is calculated. Based on this calculation result, the correction amount calculation unit 8 determines that the time is 2 seconds behind.

In FIG. 5(*d*), based on the 2 second delay thus calculated, a count value of the hand position counter 8*c* is changed to 120 (=122-2). Then, in FIG. 5(*e*), since the timer counter 8*a* indicates "122" and the hand position counter 8*c* indicates "120," the count value of the hand position counter 8*c* is increased by a count value corresponding to an amount of correction (122−120=+2). Thereby, the hand position counter 8*c* is set to "122." Thus, the motor drive unit 4 outputs a drive pulse signal corresponding to the amount of correction to the stepper motor 3, so as to move, while fast-forwarding, the second hand 2*c* to the count value of the timer counter 8*a* "122" in a forward direction.

As a result, in FIG. 5(*e*), the timer counter 8*a* indicates "122," the hand position counter 8*c* "122," and the hand detection counter 8*b* is reset to indicate "0."

Upon determination of the correction of the position displacement of the hand (second hand 2*c*), the hand drive is changed to the one second interval movement, and further, the hand position detection cycle is changed from 1 second to 60 seconds so as to be returned to a usual hand movement state.

As just described, according to the analog electronic watch 1 of this embodiment, depending on a displacement position of a hand, a position displacement correction can efficiently be performed in a short time by fast-forwarding the hand (second hand 2*c*) in a forward direction or in a reverse direction. Thus, lower power consumption of the stepper motor 3 can be achieved. Further, as to fast-forwarding a hand at the time of correction, fast-forwarding along with a correction is not performed at the time when detecting a position displacement of a hand, so that a hand position detection can be performed with high accuracy.

In addition, according to the analog electronic watch 1 of the invention, as soon as a shock is detected, the cycle at which the hand position detection means 5 detects a hand position is changed from the first detection cycle (60 seconds) to the second detection cycle (1 second), while maintaining the cycle at which the stepper motor 3 drives the hand (second hand 2*c*). Accordingly, detection of displacement of the hand position can promptly be performed with a natural normal movement of the hand.

It should be noted that, although the detection of the position displacement of the second hand 2*c* and the correction of this displacement have been described in the above-described embodiment, the invention is also applicable to the detection of position displacement and the correction thereof for the second hand 2*c* and the minute hand 2*b* as well as a date plate and a day plate that are driven through the rotation of a stepper motor.

In addition, in this embodiment, a shock detection means for the analog electronic watch 1 is configured so that a counter-electromotive force generated in the stepper motor 3 is detected and the application of a shock is thus detected based on the detection of this electromotive force. However, if the analog electronic watch 1 includes a piezoelectric element for, for example, generating an alarm sound and a piezoelectric element drive means, the piezoelectric element drive means may be configured to detect a counter-electromotive force generated in the piezoelectric element, the counter electromotive force being generated when a shock is applied on the piezoelectric element. In this way, an externally applied shock may be detected.

The configuration of the block diagram of the analog electronic watch of this embodiment shown in FIG. 1 may be a random logic configuration or a configuration of a CPU and software.

Embodiment 2

Figure 6:
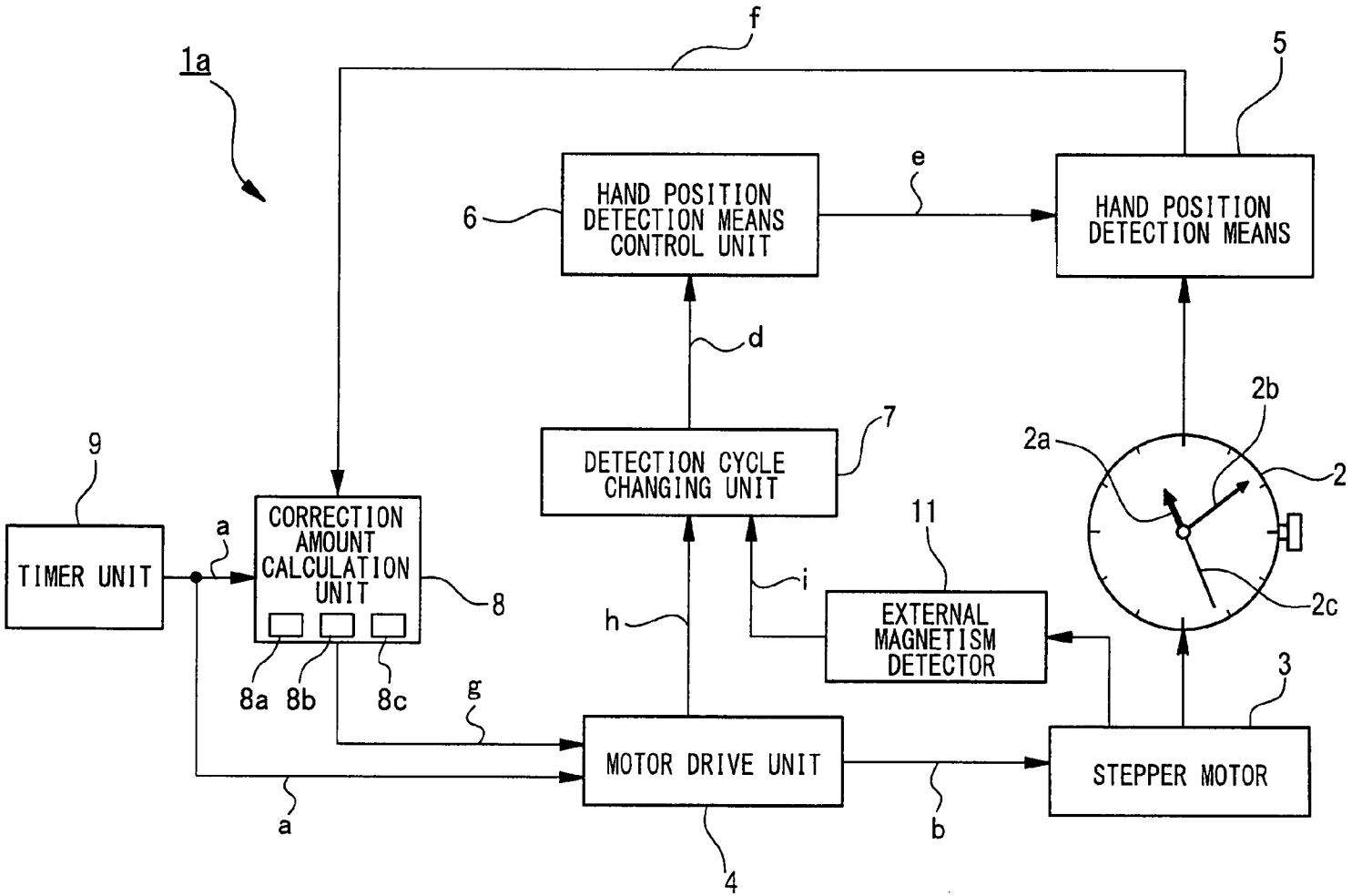
FIG. 6 is a block diagram showing a configuration of an analog electronic watch of Embodiment 2 of the invention.

FIG. 6 is a block diagram showing a configuration of an analog electronic watch of Embodiment 2 of the invention. An analog electronic watch 1*a* of this embodiment includes an external magnetism detector 11 as a hand position displacement factor detection means. Other configurations are the same as those of Embodiment 1 shown in FIG. 1, so that repetitive description will be omitted.

Based on an induced voltage generated along with the rotation of a rotor of the stepper motor 3, the external magnetism detector 11 detects magnetism (an external magnetism) externally applied on the analog electronic watch 1*a* by using a rotation detection circuit (not shown), which detects rotation/non-rotation of the rotor, as a circuit for detecting magnetism (a magnetic field) externally applied.

When there is an electric appliance (such as an electric shaver) generating magnetism is present close to the analog electronic watch 1*a*, external magnetism generated from such an electric appliance may affect the rotation of the rotor of the stepper motor 3 which drives hands (an hour hand, a minute hand, and a second hand) in such a way that the rotation of the rotor becomes unstable. As a consequence, a hand position may be displaced in some cases.

To address the above problem, in this embodiment, when an electric appliance generating magnetism is present close to the analog electronic watch 1*a* and the external magnetism detector 11 then detects the external magnetism on the analog electronic watch 1*a*, the external magnetism detector 11 outputs an external magnetism detection signal i to the detection cycle changing unit 7. As is similar to the case of Embodiment 1, in response to the thus-inputted external magnetism detection signal i, the detection cycle changing unit 7 changes the detection cycle from the first detection cycle (once every 60 seconds) to a cycle for every second, which is the second detection cycle (one second cycle), so as to perform a hand position detection every second. Note that, when the detection cycle is changed from the first detection cycle (once every 60 seconds) to the second detection cycle (one second cycle), the second hand 2*c* is still driven at a normal hand drive cycle (one second interval movement) which is the same as the second detection cycle (one second cycle).

Correction operation of displacement of a hand position in this embodiment is also the same as the flowchart of Embodiment 1 shown in FIG. 2 (except that, Step S2 is replaced by "Has external magnetism been detected?").

As just described, as is similar to the case of Embodiment 1, even when displacement of a hand position occurs due to an influence of external magnetism, a position displacement correction can efficiently be performed in a short time by fast-forwarding the hand (second hand 2*c*) in a forward direction or in a reverse direction, depending on a displaced position of the hand. Thus, lower power consumption of the stepper motor 3 can be achieved. Further, as to fast-forwarding a hand at the time of correction, fast-forwarding along with a correction is not performed at the time when detecting a position displacement of a hand, so that a hand position detection can be performed with high accuracy.

Embodiment 3

Figure 7:
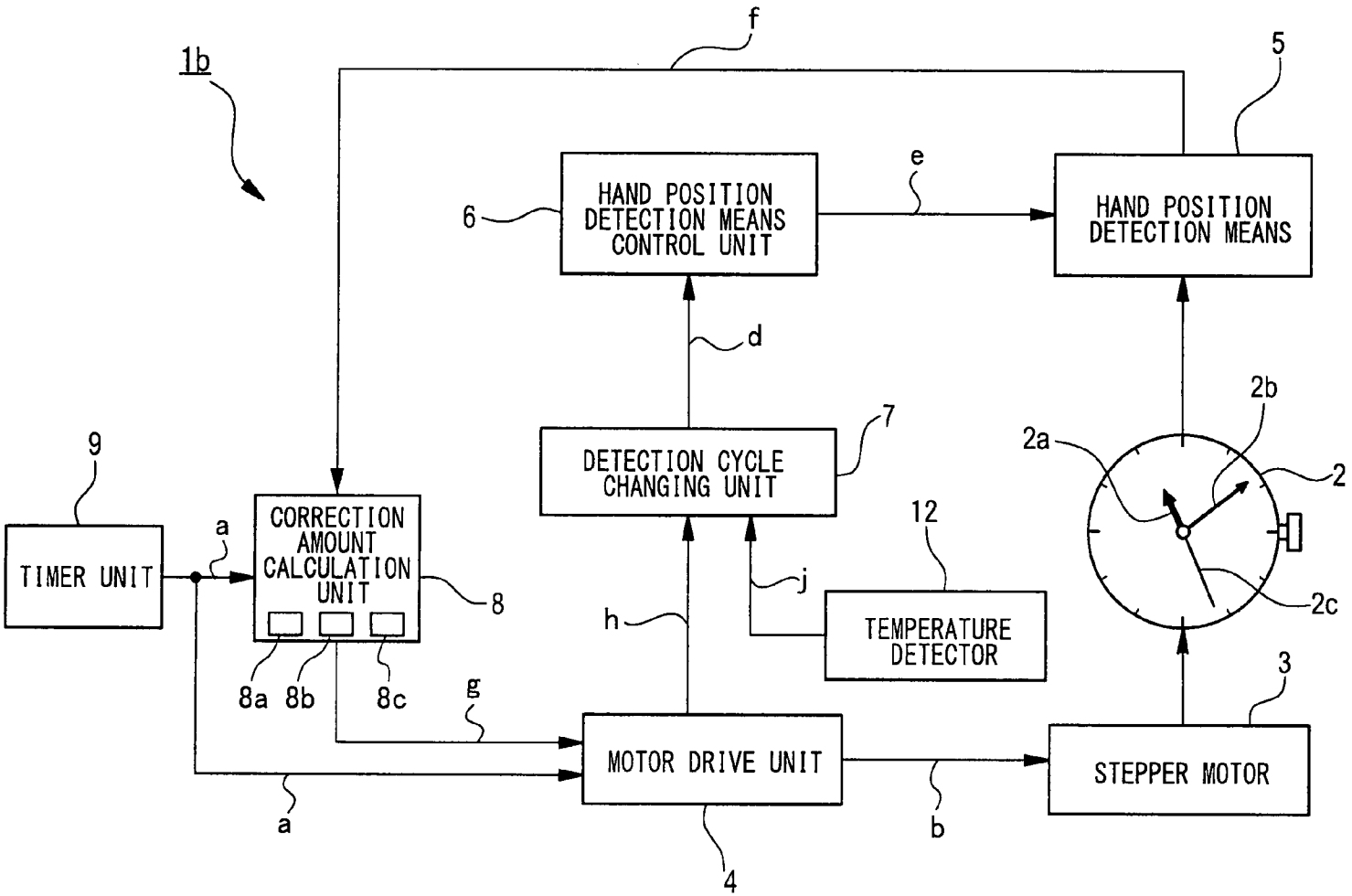
FIG. 7 is a block diagram showing a configuration of an analog electronic watch of Embodiment 3 of the invention.

FIG. 7 is a block diagram showing a configuration of an analog electronic watch of Embodiment 3 of the invention. An analog electronic watch 1*b* of this embodiment includes a temperature detector as a hand position displacement factor detection means. Other configurations are the same as those of Embodiment 1 shown in FIG. 1, so that repetitive description will be omitted.

In this embodiment, the timer unit 9 includes a rate correction unit (not shown) which performs a correction, to temperature, on a rate of a crystal oscillator as an oscillation signal source. This rate correction unit includes a temperature sensor for acquiring temperature information for correcting the rate. Therefore, the temperature detector 12 may use this temperature sensor of the rate correction unit as its own sensor, or may dispose a temperature sensor in a watch as its own dedicated sensor.

When the ambient temperature of this analog electronic watch 1*b* changes to a large degree (e.g., changes from a high-temperature environment to a low-temperature environment), the following problems may occur to cause a displacement of a hand position. Such problems include deterioration of oil for lubricant that is applied to the gear train (not shown) provided between the stepper motor 3 and hands (the hour hand 2*a*, the minute hand 2*b*, and the second hand 2*c*), and accuracy change of parts mounted inside.

To address the above problem, in this embodiment, when the temperature detector 12 detects a large change in the ambient temperature (e.g., changes from a high-temperature environment to a low-temperature environment), the temperature detector 12 outputs a temperature detection signal j to the detection cycle changing unit 7. As in the case of Embodiment 1, in response to the thus-inputted temperature detection signal j, the detection cycle changing unit 7 changes the detection cycle from the first detection cycle (once every 60 seconds) to a cycle for every second, which is the second detection cycle (one second cycle), so as to perform a hand position detection every second. Note that, when the detection cycle is changed from the first detection cycle (once every 60 seconds) to the second detection cycle (one second cycle), the second hand 2*c* is still driven at a normal hand drive cycle (one second interval movement) which is the same as the second detection cycle (one second cycle).

Operation of correcting displacement of a hand position in this embodiment is also the same as the flowchart of Embodiment 1 shown in FIG. 2 (except that Step S2 is replaced by "Has a large temperature change been detected?").

Also in this embodiment, the same effect as that of Embodiment 1 can be acquired.

It should be noted that, although the temperature detector 12 is included as a hand position displacement factor detection means in Embodiment 3, the analog electronic watch 1*b* may also be configured to include a temperature-humidity detector as a hand position displacement factor detection means for detecting ambient temperature and ambient humidity.

That is, when ambient humidity changes to a large degree (e.g., changes from a high-humidity environment to a low-humidity environment), a problem may occur such as the generation of water droplets in a watch. Such a problem may cause a displacement of a hand position. Therefore, when detecting a large change in the ambient humidity (e.g., changes from a high-humidity environment to a low-humidity environment), the temperature-humidity detector outputs a humidity detection signal to the detection cycle changing unit 7. As in the case of Embodiment 1, in response to the thus-inputted humidity detection signal, the detection cycle changing unit 7 changes the detection cycle from the first detection cycle (once every 60 seconds) to a cycle for every second, which is the second detection cycle (one second cycle), so as to perform a hand position detection every second.

Embodiment 4

Figure 8:
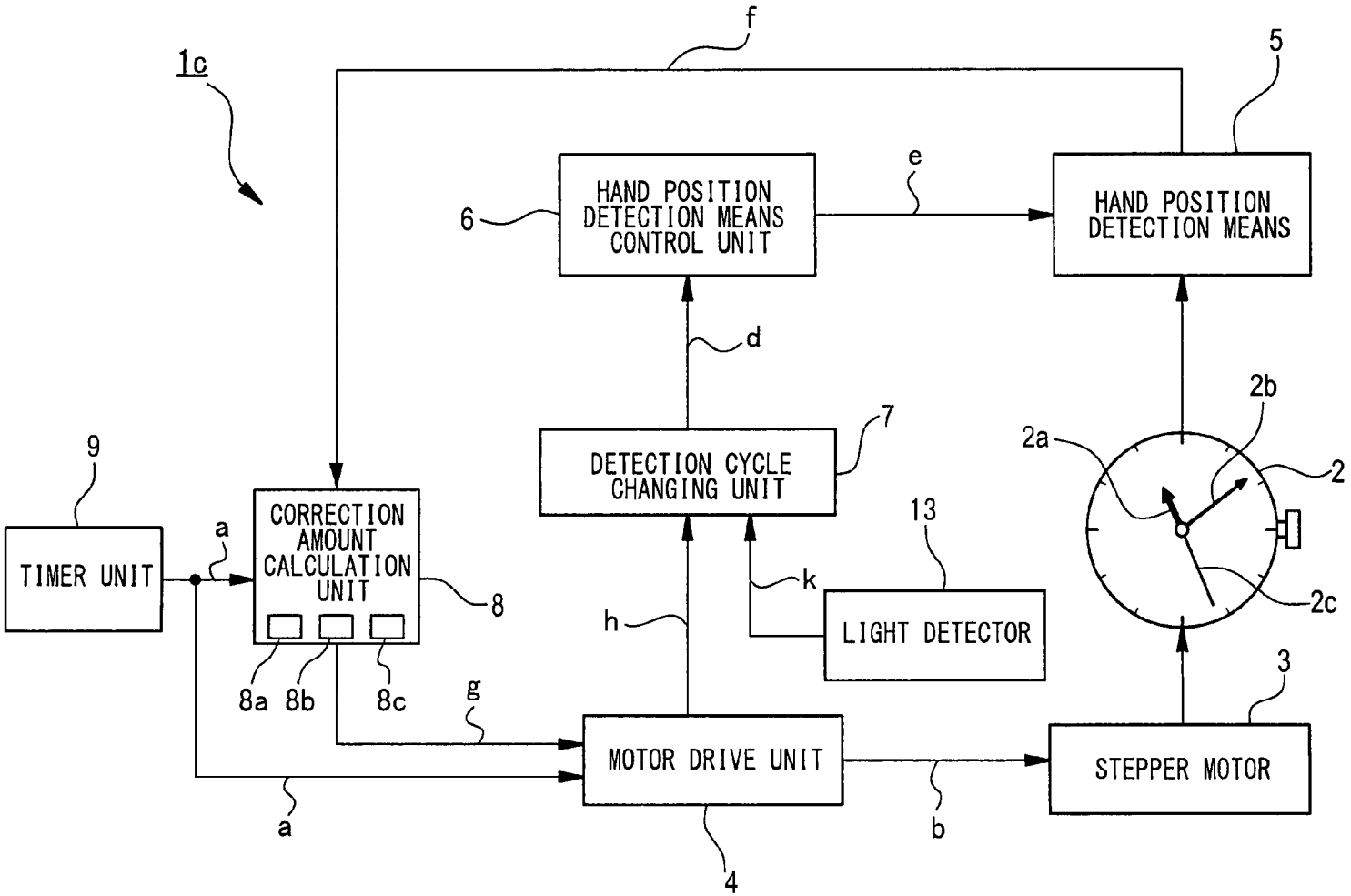
FIG. 8 is a block diagram showing a configuration of an analog electronic watch of Embodiment 4 of the invention.

FIG. 8 is a block diagram showing a configuration of an analog electronic watch of Embodiment 4 of the invention. An analog electronic watch 1*c* of this embodiment includes a light detector 13 as a hand position displacement factor detection means. Other configurations are the same as those of Embodiment 1 shown in FIG. 1, so that repetitive description will be omitted.

The light detector 13 is disposed on the back side of the display unit 2, when the display unit 2 is configured to be able to transmit light. Alternatively, when a solar cell (not shown) is included as a power source of the analog electronic watch 1*c*, this solar cell may also be used as the light detector 13. Generated power acquired from the solar cell is charged to (or stored in) a secondary battery such as a lithium-ion battery, and this power thus charged is used as a drive power. The solar cell is disposed on the back side of the display unit 2 capable of transmitting light.

Mounted on the back side of the display unit 2 of this analog electronic watch 1*c* is an integrated circuit unit including the motor drive unit 4, the hand position detection means control unit 6, the detection cycle changing unit 7, the correction amount calculation unit 8, and the like. In general, when illuminated with excessively bright light, the integrated circuit unit may malfunction. Specifically, when the integrated circuit unit is illuminated by such a way that bright light enters an opening, provided to the center of the display unit 2, for passing rotation axes of hands (the hour hand 2*a*, the minute hand 2*b*, and the second hand 2*c*), the integrated circuit unit may malfunction (output a fault signal). Such malfunction may cause a hand position to be displaced.

To address the above problem, in this embodiment, when detecting that the integrated circuit unit is illuminated with bright light having an illumination intensity higher than a predetermined value (light having a high intensity of illumination), the light detector 13 outputs a light detection signal k to the detection cycle changing unit 7. As in the case of Embodiment 1, in response to the thus-inputted light detection signal k, the detection cycle changing unit 7 changes the detection cycle from the first detection cycle (once every 60 seconds) to a cycle for every second, which is the second detection cycle (one second cycle), so as to perform a hand position detection every second. Note that, when the detection cycle is changed from the first detection cycle (once every 60 seconds) to the second detection cycle (one second cycle), the second hand 2*c* is still driven at a normal hand drive cycle (one second interval movement) which is the same as the second detection cycle (one second cycle).

Operation of correcting displacement of a hand position in this embodiment is also the same as the flowchart of Embodiment 1 shown in FIG. 2 (except that Step S2 is replaced by "Has bright light having an illumination intensity higher than a predetermined value (light having a high intensity of illumination) been detected?").

Also in this embodiment, the same effect as that of Embodiment 1 can be acquired.

Embodiment 5

Figure 9:
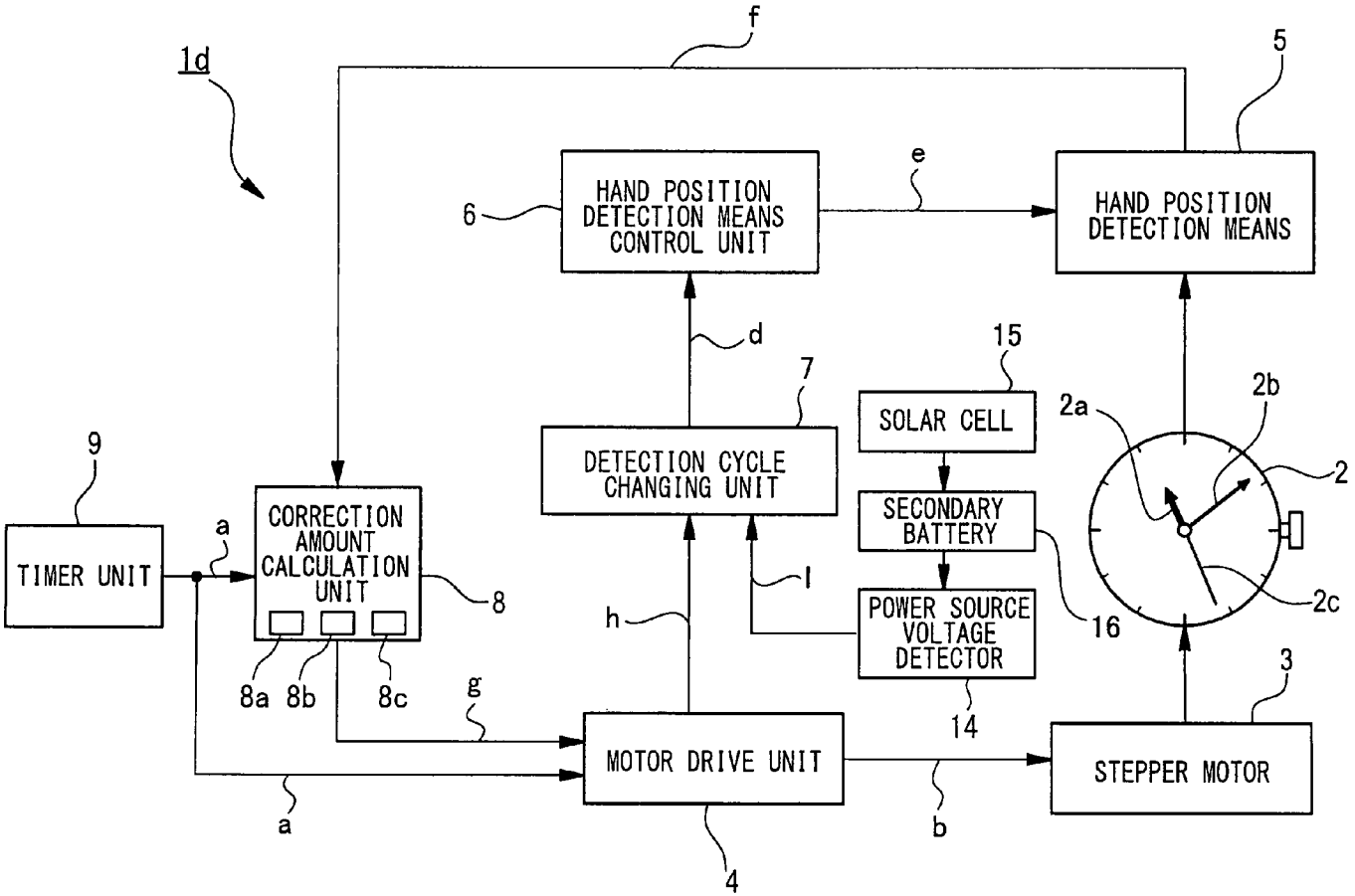
FIG. 9 is a block diagram showing a configuration of an analog electronic watch of Embodiment 5 of the invention.

FIG. 9 is a block diagram showing a configuration of an analog electronic watch of Embodiment 5 of the invention. An analog electronic watch 1*d* of this embodiment includes a power source voltage detector 14 as a hand position displacement factor detection means. Other configurations are the same as those of Embodiment 1 shown in FIG. 1, so that repetitive description will be omitted.

The analog electronic watch 1*d* includes a solar cell 15 and a secondary battery 16 as power sources. Generated power acquired from the solar cell 15 is charged to (or stored in) the secondary battery 16 such as a lithium-ion battery, and this power thus charged is used as a drive power. The solar cell 15 is disposed on the back side of the display unit 2 capable of transmitting light. The power source voltage detector 14 detects voltage of the power charged to the secondary battery 16.

When the solar cell 15 is illuminated with bright light (light having a high intensity of illumination) for a long time, power may be overcharged to the secondary battery 16. When the secondary battery 16 is in an overcharged state, recoil of the stepper motor 3 may cause a displacement of a hand position.

Therefore, when detecting that power higher than a predetermined value is charged (overcharge) to the secondary battery 16, the power source voltage detector 14 outputs a high voltage detection signal 1 to the detection cycle changing unit 7. As in the case of Embodiment 1, in response to the thus-inputted high voltage detection signal 1, the detection cycle changing unit 7 changes the detection cycle from the first detection cycle (once every 60 seconds) to a cycle for every second, which is the second detection cycle (one second cycle), so as to perform a hand position detection every second. Note that, when the detection cycle is changed from the first detection cycle (once every 60 seconds) to the second detection cycle (one second cycle), the second hand 2*c* is still driven at a normal hand drive cycle (one second interval movement) which is the same as the second detection cycle (one second cycle).

Operation of correcting a displacement of a hand position in this embodiment is also the same as the flowchart of Embodiment 1 shown in FIG. 2 (except that Step S2 is replaced by "Has a high voltage been detected?").

Also in this embodiment, the same effect as that of Embodiment 1 can be acquired.

Embodiment 6

Figure 10:
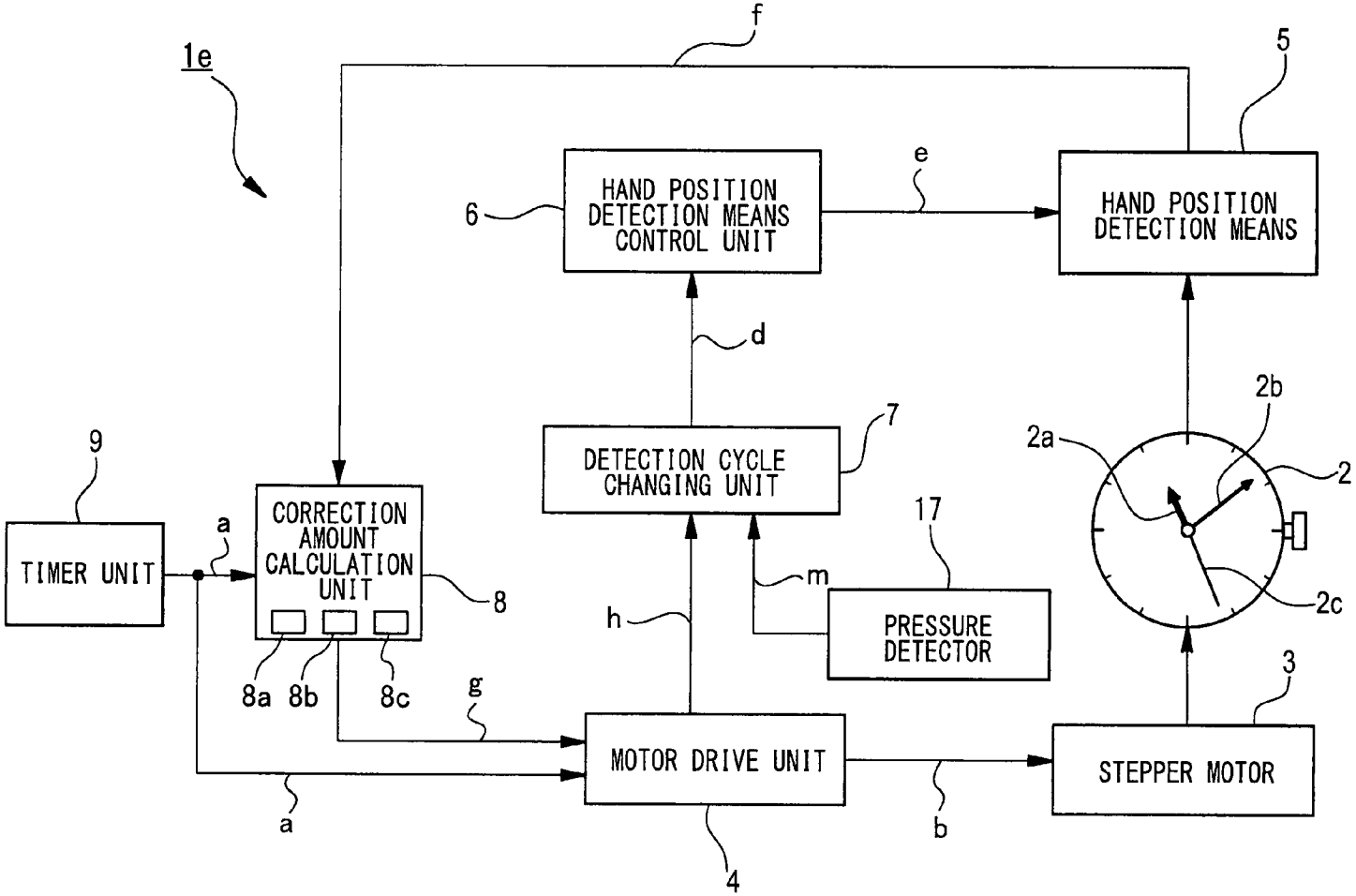
FIG. 10 is a block diagram showing a configuration of an analog electronic watch of Embodiment 6 of the invention.

FIG. 10 is a block diagram showing a configuration of an analog electronic watch of Embodiment 6 of the invention. An analog electronic watch 1*e* of this embodiment includes a pressure detector 17 as a hand position displacement factor detection means. Other configurations are the same as those of Embodiment 1 shown in FIG. 1, so that repetitive description will be omitted.

In response to an output signal from a pressure sensor (not shown), the pressure detector 17 detects pressure applied on an exterior surface (a glass surface) or the like, of the display unit 2 of the analog electronic watch 1*e*. When the analog electronic watch 1*e* is a wrist watch (a diver watch) which has a function for displaying the value of a water depth using a fathometer with a pressure sensor, this fathometer may also be used as the pressure sensor 17.

When, for example, one dives into water (sea) with the analog electronic watch 1*e*, high pressure acts on a glass plate (not shown) fixed to a surface of the display unit 2, so that the glass plate is slightly deformed inward to get in contact with a hand. This may cause a hand position to be displaced.

To address the above problem, in this embodiment, when, for example, one dives into water (sea) with the analog electronic watch 1*e*, and when detecting high pressure acting on the glass plate of the surface of the display unit 2, the pressure sensor 17 outputs a high pressure detection signal m to the detection cycle changing unit 7. As in the case of the Embodiment 1, in response to the thus-inputted high pressure detection signal m, the detection cycle changing unit 7 changes the detection cycle from the first detection cycle (once every 60 seconds) to a cycle for every second, which is the second detection cycle (one second cycle), so as to perform a hand position detection every second. Note that, when the detection cycle is changed from the first detection cycle (once every 60 seconds) to the second detection cycle (one second cycle), the second hand 2*c* is still driven at a normal hand drive cycle (one second interval movement) which is the same as the second detection cycle (one second cycle).

Operation of correcting the displacement of a hand position in this embodiment is also the same as the flowchart of Embodiment 1 shown in FIG. 2 (except that Step S2 is replaced by "Has high pressure been detected?").

Also in this embodiment, the same effect as that of Embodiment 1 can be acquired.

Embodiment 7

Figure 11:
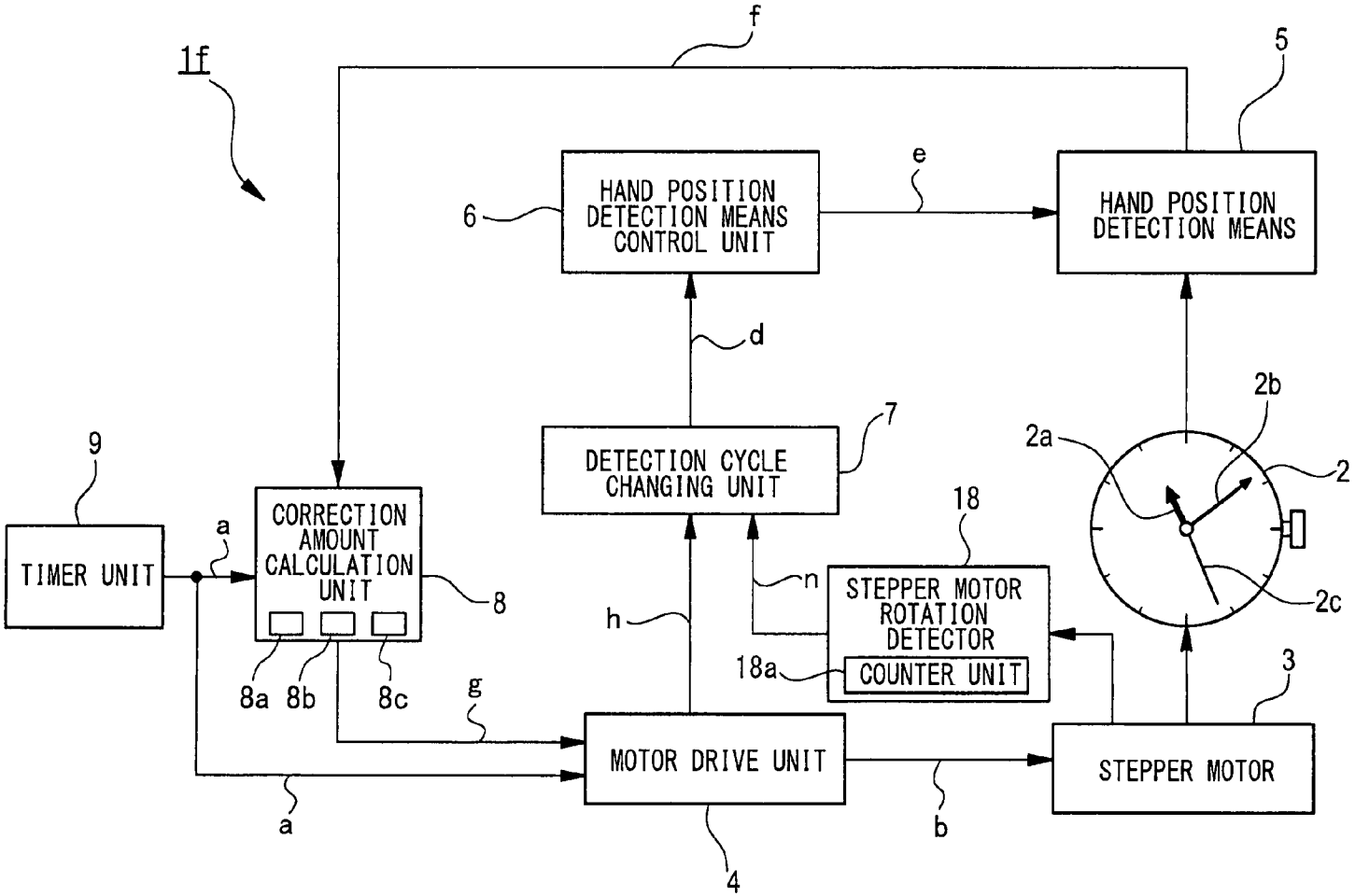
FIG. 11 is a block diagram showing a configuration of an analog electronic watch of Embodiment 7 of the invention.

FIG. 11 is a block diagram showing a configuration of an analog electronic watch of Embodiment 7 of the invention. An analog electronic watch if of this embodiment includes a stepper motor rotation detector 18 as a hand position displacement factor detection means. Other configurations are the same as those of Embodiment 1 shown in FIG. 1, so that repetitive description will be omitted.

The stepper motor rotation detector 18 detects whether the stepper motor 3 is in rotation or not, by detecting a magnetic field generated along with the rotation of the rotor of the stepper motor 3. Further, the stepper motor rotation detector 18 includes a counter unit 18*a* which performs counting when the stepper motor 3 is determined not to be in rotation.

When this analog electronic watch if is under a heavy load, power source voltage variation occurs due to an impedance of a battery (a primary battery or a secondary battery) as a power source, so that the operation of the stepper motor 3 becomes unstable and, consequently, a hand position may be displaced.

Therefore, in this embodiment, assume that the analog electronic watch if is under a heavy load. When detecting that a count value, counted by the counter unit 18*a* when the stepper motor 3 is determined not to be in rotation, is a predetermined value or more, the stepper motor rotation detector 18 outputs a detection signal n to the detection cycle changing unit 7. As in the case of Embodiment 1, in response to the thus-inputted detection signal n, the detection cycle changing unit 7 changes the detection cycle from the first detection cycle (once every 60 seconds) to a cycle for every second, which is the second detection cycle (one second cycle), so as to perform a hand position detection every second. Note that, when the detection cycle is changed from the first detection cycle (once every 60 seconds) to the second detection cycle (one second cycle), the second hand 2*c* is still driven at a normal hand drive cycle (one second interval movement) which is the same as the second detection cycle (one second cycle).

Operation of correcting the displacement of a hand position in this embodiment is also the same as the flowchart of Embodiment 1 shown in FIG. 2 (except that Step S2 is replaced by "Is a count value counted when the stepper motor 3 is determined not to be in rotation a predetermined value or more?").

Also in this embodiment, the same effect as that of Embodiment 1 can be acquired.

In addition, the stepper motor rotation detector 18 in this embodiment can also be used as the external magnetism detector of Embodiment 2. That is, since, as described above, the stepper motor rotation detector 18 detects whether the stepper motor 3 is in rotation or not by detecting a magnetic field generated along with the rotation of the rotor of the stepper motor 3, the stepper motor rotation detector 18 is also capable of detecting magnetism generated in the stepper motor 3 when external magnetism is generated. Therefore, when detecting external magnetism, the stepper motor rotation detector 18 outputs an external magnetism detection signal to the detection cycle changing unit 7, as described above.

This embodiment is effective as a means for dealing with cases where hand position displacement factors cannot directly be detected, such factors including static electricity, dust, and erroneous operation.

Embodiment 8

Figure 12:
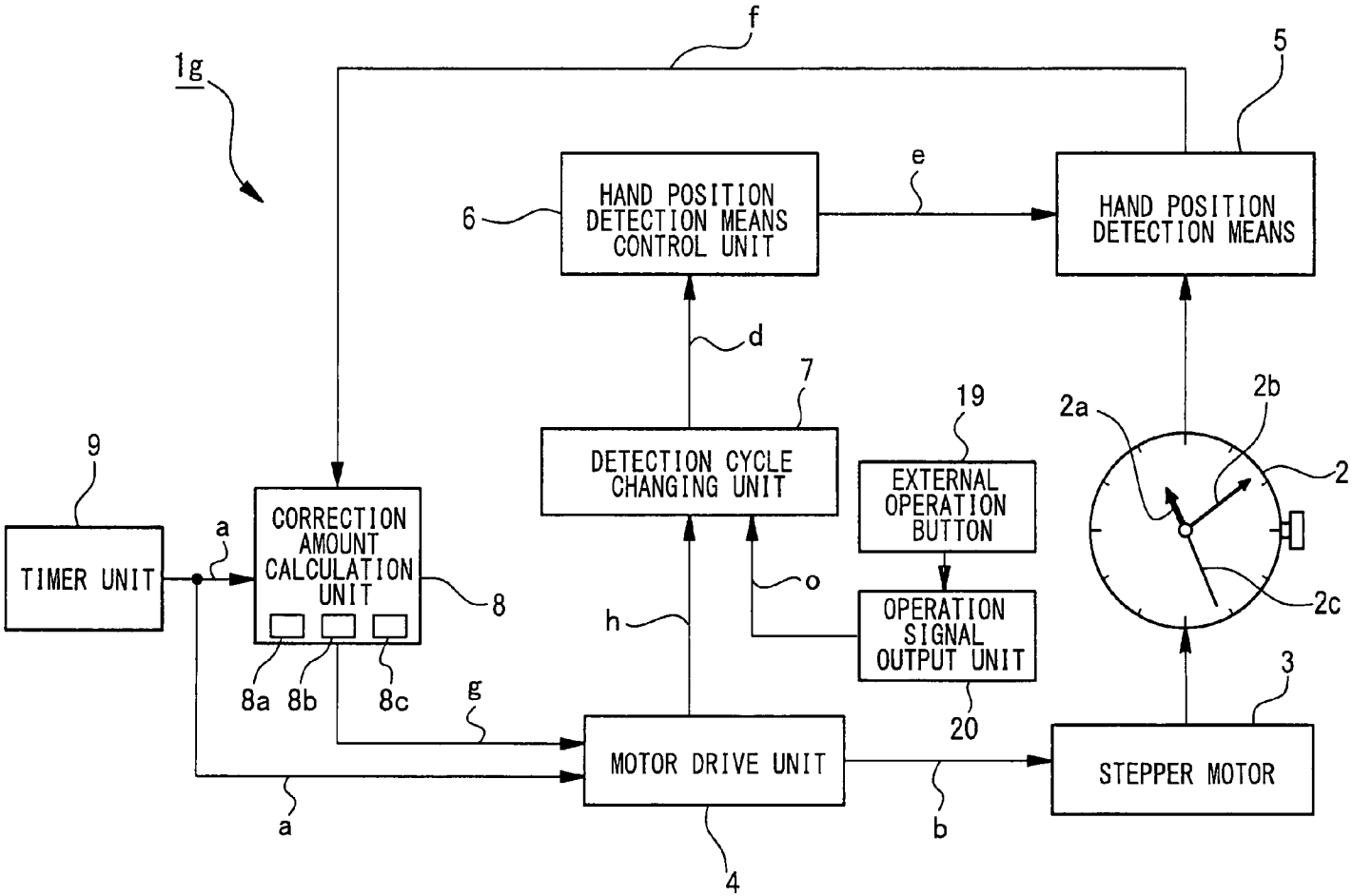
FIG. 12 is a block diagram showing a configuration of an analog electronic watch of Embodiment 8 of the invention.

FIG. 12 is a block diagram showing a configuration of an analog electronic watch of Embodiment 8 of the invention. An analog electronic watch 1*g* of this embodiment includes an external operation button 19 and an operation signal output unit 20 as hand position displacement factor detection means. Other configurations are the same as those of Embodiment 1 shown in FIG. 1, so that repetitive description will be omitted.

When watching the movement of a hand, a user feels in some cases that a hand position is displaced due to generation of static electricity in the analog electronic watch 1*g*, secular change of oil applied to mounted movable parts, attachment of dust to mounted movable parts, erroneous operation by a user, and the like. When such a situation occurs, the operation of the stepper motor 3 becomes unstable, so that a hand position may be displaced.

Therefore, in this embodiment, when the above situation has occurred and when a user feels that a hand position is displaced by watching the movement of a hand, the user pushes the external operation button 19. In response to this, the operation signal output unit 20 outputs an operation signal o to the detection cycle changing unit 7. As in the case of Embodiment 1, in response to the operation signal o thus inputted, the detection cycle changing unit 7 changes the detection cycle from the first detection cycle (once every 60 seconds) to a cycle for every second, which is the second detection cycle (one second cycle), so as to perform a hand position detection every second. Note that, when the detection cycle is changed from the first detection cycle (once every 60 seconds) to the second detection cycle (one second cycle), the second hand 2*c* is still driven at a normal hand drive cycle (one second interval movement) which is the same as the second detection cycle (one second cycle).

Operation of correcting the displacement of a hand position in this embodiment is also the same as the flowchart of Embodiment 1 shown in FIG. 2 (except that Step S2 is replaced by "Has an external operation button been pushed?").

Also in this embodiment, the same effect as that of Embodiment 1 can be acquired.

Embodiment 9

Figure 13:
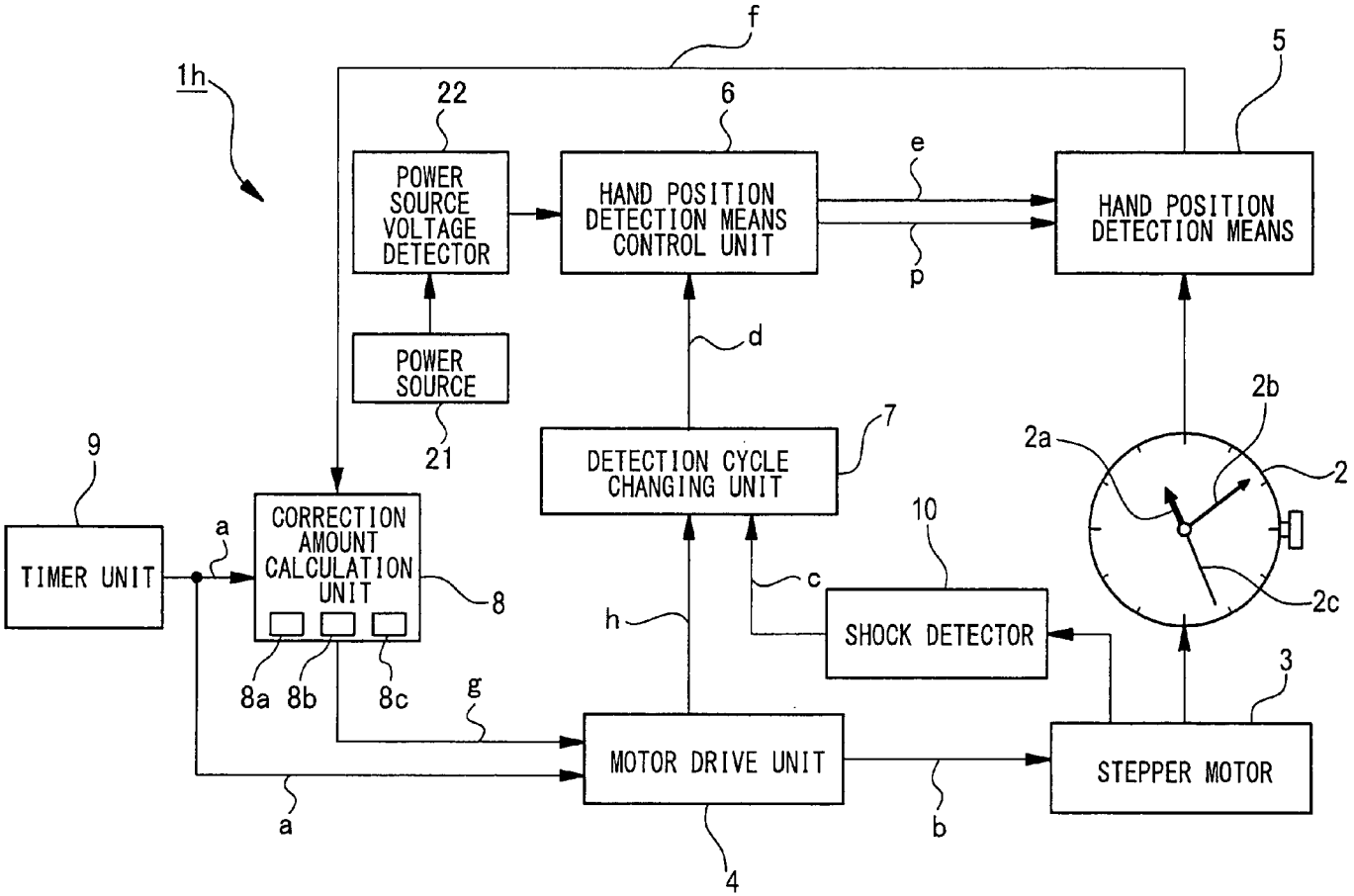
FIG. 13 is a block diagram showing a configuration of an analog electronic watch of Embodiment 9 of the invention.

FIG. 13 is a block diagram showing a configuration of an analog electronic watch of Embodiment 9 of the invention. An analog electronic watch 1*h* of this embodiment includes a power source voltage detector 22 detecting a voltage of a power source 21. Other configurations are the same as those of Embodiment 1 shown in FIG. 1, so that repetitive description will be omitted. Further, although the shock detector 10 is included as a hand position displacement factor detection means in this embodiment, any of the detectors described above in the respective embodiments may be included.

The analog electronic watch 1*h* includes a solar cell, and a secondary battery such as a lithium-ion battery for charging (or storing) generated power acquired from this solar cell, and the power source voltage detector 22 detects voltage of power stored in the power source 21. The solar cell is disposed on the back side of the display unit 2 capable of transmitting light.

Further, as in the case of Embodiment 1, the hand position detection means 5 is a transparent type hand position detection sensor in which a movable member is provided between a light emitting device such as an LED and a light receiving device such as a phototransistor, which face each other, so that the movable member is capable of moving in conjunction with the rotation of the hand (the second hand 2*c*). In the sensor, when a light emitted from the light emitting device passes through a detection hole formed on the movable member, and is then received by the light receiving device, the hand (second hand 2*c*) is determined to be at the normal position.

When an ambient illumination intensity of the analog electronic watch 1*h* is low for a long time, electric power generated by the solar cell of the power source 21 is reduced, so that voltage (power source voltage) stored in the secondary battery of the power source 21 is also reduced. In addition, when the hand position detection means 5 performs the normal hand position detection, the power source voltage is further reduced. Therefore, when the voltage (power source voltage) stored in the secondary battery of the power source 21 is reduced, the hand position detection means 5 cannot perform a stable normal hand position detection. In addition, when the voltage (power source voltage) stored in the secondary battery of the power source 21 is reduced, an abnormal movement of the hand may occur.

Figure 14:
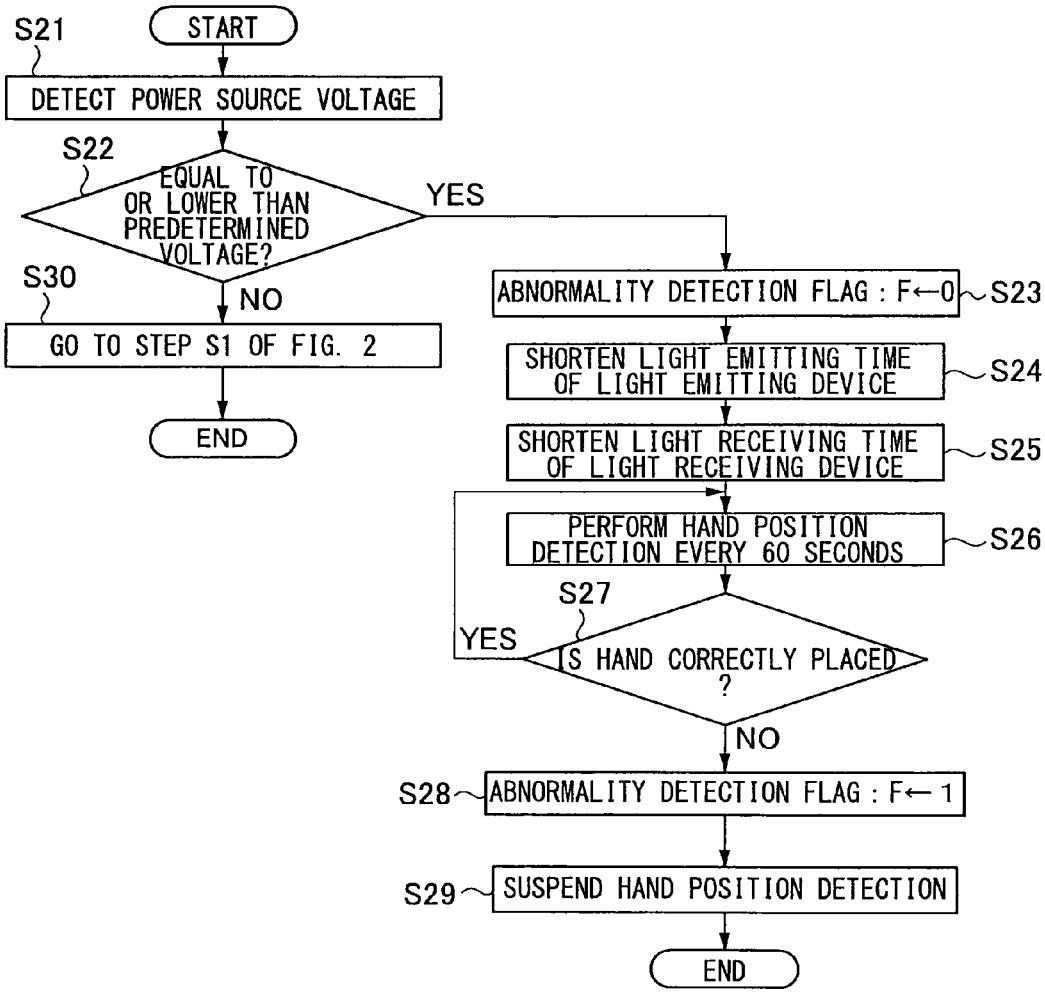
FIG. 14 is a flowchart showing process operation in Embodiment 9 in the case where a voltage (power supply voltage) stored in a secondary battery of a power source is reduced.

Referring to a flowchart shown in FIG. 14, description will be given below of process operation of this embodiment in the case where the voltage (power source voltage) stored in the secondary battery of the power source 21 is reduced.

First, in Step S21, the power source voltage of the power source (secondary battery) is detected by the power source voltage detector 22, and when a power source voltage thus detected is equal to or lower than a predetermined voltage set in advance (Step S22: YES), an abnormality detection flag F is reset to "0" (Step S23). The predetermined voltage is a charge warning voltage indicating a necessity of charging because of a decrease from a usual voltage. When an abnormality detection flag F indicates "0," an abnormality is not detected in a hand drive, that is, a hand drive is in its normal state, whereas when the abnormality detection flag F indicates "1," an abnormality is detected in a hand drive.

In Step S23, after the abnormality detection flag F is reset to "0," the hand position detection means control unit 6 outputs a signal p to the hand position detection means 5 so as to shorten light emitting time of a light emitting device (LED) (Step S24), and to shorten light receiving time of a light receiving device (phototransistor) (Step S25) at the time of hand position detection. The process of shortening of the light receiving time of the light emitting device (LED) causes the light emitting time to be, for example, shortened from 1.5 msec at a normal time to 0.5 msec.

The above processes can reduce current which the light emitting device (LED) and the light receiving device (phototransistor) consume at the time of hand position detection. In addition, the shortening of the operation time (light receiving time) of the light receiving device (phototransistor) is also effective in preventing erroneous operation due to noise.

The hand position detection means 5 performs a usual hand position detection once every 60 seconds which is the first detection cycle (Step S26). While the hand position detection means 5 performs a usual hand position detection once every 60 seconds using (Step S26), when the hand position (the second hand 2*c*) is properly placed (Step S27: YES), the process returns to Step S26 to continue detection.

Thereafter, in Step S27, at the time of occurrence of abnormality where the hand (second hand 2*c*) position is determined to be displaced (Step S27: NO), the abnormality detection flag F is set to "1" (Step S28). Then, subsequent processes, which are a hand position detection process and a hand position displacement correction process, are suspended (Step S29).

The reason why the hand position displacement correction process is not performed in Step S29 is that even when an abnormality is detected and thereafter the detection cycle is changed to one second interval detection to calculate an amount of correction, the movement of the hand for correction cannot be performed. This is because it is difficult to fast-forward the hand using the stepper motor 3, and particularly, a reverse movement of the hand is not stable, under the condition that a battery voltage is reduced.

Further, in Step S22, when voltage is not reduced to one equal to or lower than the predetermined voltage set in advance and a normal power source voltage is retained (Step S22: NO), as in the case of Embodiment 1 for example, the process proceeds to Step S1 in the flowchart shown in FIG. 2 so as to perform operation of detecting the hand position and correcting a hand position displacement. Light emitting time of the light emitting device (LED) of the hand position detection means 5 at the time of hand position detection is, for example, 1.5 msec which is usual.

Assume a case where, when the hand position detection operation is under suspension (Step S29) due to reduction of the power source voltage to the predetermined voltage or less in Step S22, the solar cell being the power source 21 is illuminated with light, so as to be charged with a voltage equal to or higher than the predetermined voltage and to thus restore the power source voltage to a normal voltage. In this case, shortened light emitting time (0.5 msec) of the light emitting device (LED) is restored to the normal light emitting time (1.5 msec), and the light receiving time of the light receiving device (phototransistor) is restored to the normal time as well.

After Step S29, after the power source voltage is restored to the normal voltage (equal to or higher than the predetermined voltage), the process moves to Step S5 of the flowchart of Embodiment 1 shown in FIG. 2 to perform a detection process on the hand position immediately after the abnormality detection flag F is reset to "0" since the abnormality has been detected in Step S27.

Further, alternatively, after the power source voltage is restored to the normal voltage (equal to or higher than the predetermined voltage) as described above, although the abnormality has been detected in Step S27, the process may proceed to Step S3 of the flowchart of Embodiment 1 shown in FIG. 2 after the abnormality detection flag F is reset to "0," in order to perform a detection process on a hand position at 60 second cycle. This is because, since the light emitting time of the light emitting device (LED) is shortened, detection accuracy needs to be improved.

As described above, in this embodiment, even when the power source voltage is reduced to one equal to or lower than the predetermined voltage, the light emitting time of the light emitting device (LED) and the light receiving time of the light receiving device (phototransistor), of the hand position detection means 5, are shortened without suspending the hand position detection operation, so as to reduce current to be consumed. Thereby, the hand position detection can be performed with consumption of the power source voltage suppressed at a minimum level.

Further, when an abnormality of the hand position is detected by the hand position detection while the power source voltage is equal to or lower than the predetermined voltage, the subsequent hand position detection and hand position displacement processes are suspended. Thereby, further consumption of the power source voltage can be checked.

Embodiment 10

In Embodiment 9, when an abnormality of the hand position is detected by the hand position detection while the power source voltage is equal to or lower than the predetermined voltage, the subsequent hand position detection and hand position displacement processes are suspended. In Embodiment 10, however, when an abnormality of the hand position is detected by the hand position detection while the power source voltage is equal to or lower than the predetermined voltage, a hand position detection process is performed. Other configurations are the same as those of Embodiment 9 shown in FIG. 13, so that repetitive description will be omitted.

Figure 15:
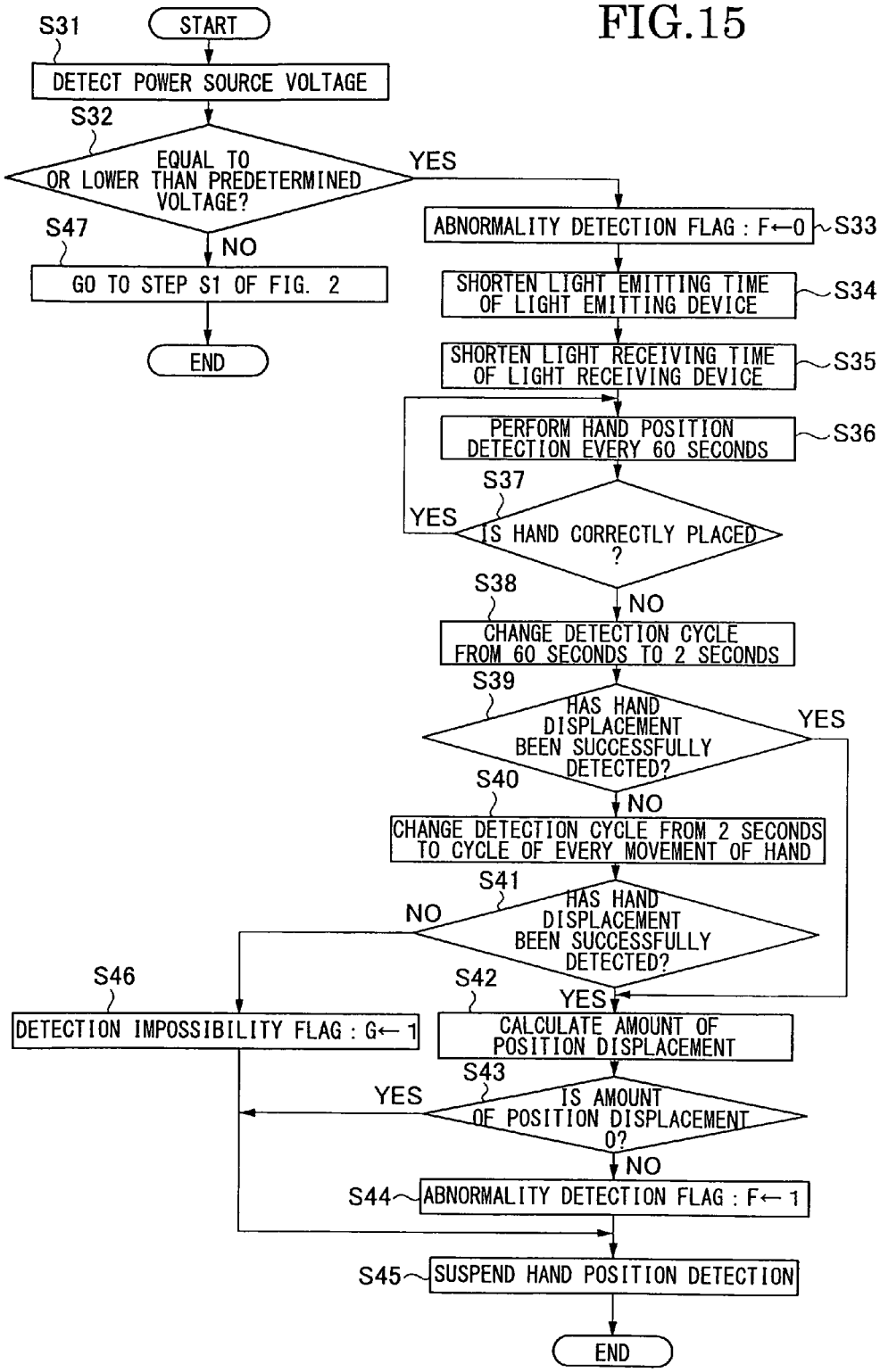
FIG. 15 is a flowchart showing process operation in Embodiment 10 in the case where a voltage (power supply voltage) stored in a secondary battery of a power source is reduced.

Referring to a flowchart shown in FIG. 15, description will be given below of operation performed in this embodiment when the voltage (power source voltage) stored in the secondary battery of the power source 21 is reduced.

First, in Step S31, the power source voltage of the power source (secondary battery) 21 is detected by the power source voltage detector 22. When a power source voltage thus detected is equal to or lower than a predetermined voltage set in advance (Step S32: YES), a normality detection flag F is reset to "0" (Step S33). The predetermined voltage is a charge warning voltage indicating a necessity of charging because of a decrease from a usual voltage. When an abnormality detection flag F indicates "0," an abnormality is not detected in a hand drive, that is, a hand drive is in a normal state, whereas when the abnormality detection flag F indicates "1," an abnormality is detected in a hand drive.

After the abnormality detection flag F is reset to "0" in Step S33, the hand position detection means control unit 6 outputs a signal p to the hand position detection means 5, so as to shorten light emitting time of a light emitting device (LED) (Step S34), and to shorten light receiving time of a light receiving device (phototransistor) (Step S35) at the time of hand position detection. The process of shortening the light receiving time of the light emitting device (LED) in Step S34 causes the light emitting time to be, for example, shortened from 1.5 msec at a normal time to 0.5 msec. The above processes can reduce current which the light emitting device (LED) and the light receiving device (phototransistor) consume at the time of hand position detection.

Then, the hand position detection means 5 performs a usual hand position detection once every 60 seconds which is the first detection cycle (Step 36). When a position of the hand (the second hand 2*c*) is properly placed while the hand position detection means 5 performs a usual hand position detection once every 60 seconds (Step S37: YES), the process returns to Step S36 to continue detection.

Thereafter, in Step S37, at the time of occurrence of abnormality where the position of the hand (second hand 2*c*) is determined to be displaced (Step S37: NO), the detection cycle is changed from the first detection cycle (60 second cycle) to a detection cycle of once every two seconds (2 second cycle), so as to perform the hand position detection once every two seconds as shown in FIG. 16(*a*), for example (Step S38).

Figure 16:
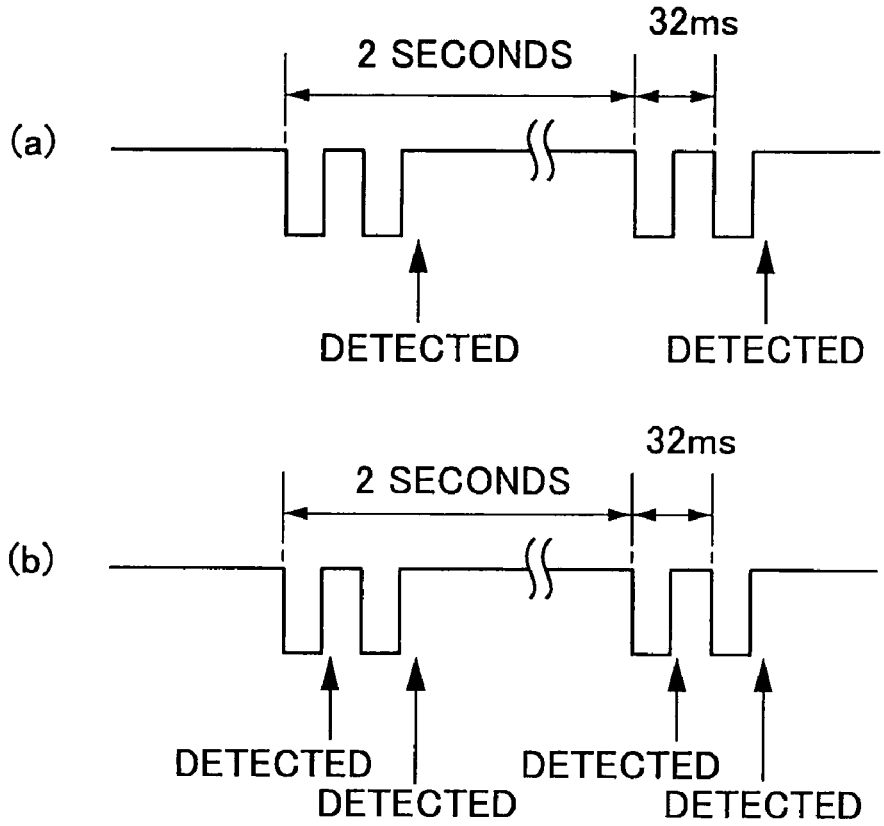
FIG. 16(*a*) is a view showing a hand position detection operation in the case where a 60 second cycle is changed to a 2 second cycle, and FIG. 16(*b*) is a view showing a hand position detection operation in the case where a 2 second cycle is changed to a detection cycle per hand movement.

Such a detection method is applied when the power source voltage is reduced to be at a low level in order to warn the user to charge by performing an irregular hand movement at a cycle of 2 seconds as shown in FIG. 16(*a*).

When no hand position displacement can be detected while performing a hand position detection operation every two seconds (Step S39: NO), the detection cycle is changed from the detection cycle of once every two seconds (2 second cycle) to that of every hand movement, so as to perform a hand position detection every hand movement as shown in FIG. 16(*b*), for example (Step S40). In FIG. 16(*b*), hand position displacement is detected at each output of a pulse signal.

When a hand displacement is successfully detected in Step S41 while performing a hand position detection operation every hand movement (Step S41: YES), and when a hand displacement is successfully detected while performing a hand position detection operation every two seconds (Step S439: YES), an amount of displacement of the hand at that time is calculated by the correction amount calculation unit 8, and this calculation result is stored (Step S42).

When the amount of displacement thus calculated is not zero, that is, when an abnormality that a hand position is displaced has occurred (Step S43: NO), the abnormality detection flag F is set to "1" (Step S44). Then, the subsequent hand position detection process is suspended (Step S45).

In Step S43, when the calculated amount of displacement is zero, that is, when no hand position displacement occurs (Step S43: YES), the subsequent hand position detection is suspended (Step S45).

In addition, when a hand displacement is unsuccessfully detected in Step S41 while performing a hand position detection operation every hand movement (Step S41: NO), and when a detection disable flag G has been reset to "0," the detection disable flag G is set to "1" (Step S46). Then, the subsequent hand position detection process is suspended (Step S45). The detection disable flag G indicates "1" when the detection of the hand displacement is unsuccessful, while the detection disable flag G indicates "0" when the detection of the hand displacement is successful.

Further, in Step S32, when voltage is not reduced to one equal to or lower than a predetermined voltage set in advance and when a normal power source voltage is retained (Step S32: NO), the process moves to Step S1 in the flowchart shown in FIG. 2 as in the case of Embodiment 1 for example (Step S47), so as to perform operation of detecting the hand position and correcting the hand position displacement. At this time, light emitting time of the light emitting device (LED) of the hand position detection means 5 at the time of hand position detection is, for example, 1.5 msec which is usual.

Assume a case where, when the hand position detection operation is under suspension (Step S45) due to reduction of the power source voltage to the predetermined voltage or less in Step S32, the solar cell being the power source 21 is illuminated with light, so as to be charged with a voltage equal to or higher than the predetermined voltage, which restores the power source voltage to a normal voltage. In this case, the following processes are performed: shortened light emitting time (0.5 msec) of the light emitting device (LED) is restored to the normal light emitting time (1.5 msec); and the light receiving time of the light receiving device (phototransistor) is restored to the normal time as well.

After Step S45, after the power source voltage is restored to the normal voltage (equal to or higher than the predetermined voltage), it is determined whether the abnormality detection flag F is set to "1." and when the abnormality detection flag F is set to "1" (the abnormality of the hand movement is detected), a correction operation is performed on the hand position displacement, based on the amount of hand displacement calculated and stored in Step S42.

After Step S45, after the power source voltage is restored to the normal voltage (equal to or higher than the predetermined voltage), it is determined whether the abnormality detection flag F is set to "1," and when the abnormality detection flag F is reset to "0" (the abnormality of the hand movement is not detected, that is, the hand movement is normal), it is determined whether the detection disable flag G is set to "1."

In the above determination, when the detection disable flag G is set to "1," it means the failure of the detection of the hand displacement, so that the process moves to Step S3 of the flowchart of Embodiment 1 shown in FIG. 2 to newly perform hand displacement detection. On the other hand, when the detection disable flag G is reset to "0," it means that the detection of the hand displacement has successfully performed and that an abnormality of the hand movement has not been detected, that is, the hand movement is normal, so that the process is terminated.

As described above, in this embodiment, even when the power source voltage is reduced to one equal to or lower than the predetermined voltage, the light emitting time of the light emitting device (LED) and the light receiving time of the light receiving device (phototransistor), of the hand position detection means 5, are shortened without suspending the hand position detection operation, so as to reduce current to be consumed. Thereby, the hand position detection can be performed with consumption of the power source voltage suppressed at a minimum level.

Further, in this embodiment, while the power source voltage is equal to or lower than the predetermined voltage, when an abnormality of the hand position is detected by performing the hand position detection with the light emitting time of the light emitting device (LED) being shortened, the detection cycle is changed (changed from 60 second cycle to a detection cycle of once every two seconds (2 second cycle), but when failing the detection, changed from 60 second cycle to a cycle of every hand movement) to perform a hand position detection process. When a hand displacement has been successfully detected, an amount of hand displacement is stored without correcting the hand displacement. When the hand displacement has not been successfully detected, the subsequent hand position detection process is suspended. In this way, further consumption of the power source voltage can be checked.

Embodiment 11

Figure 17:
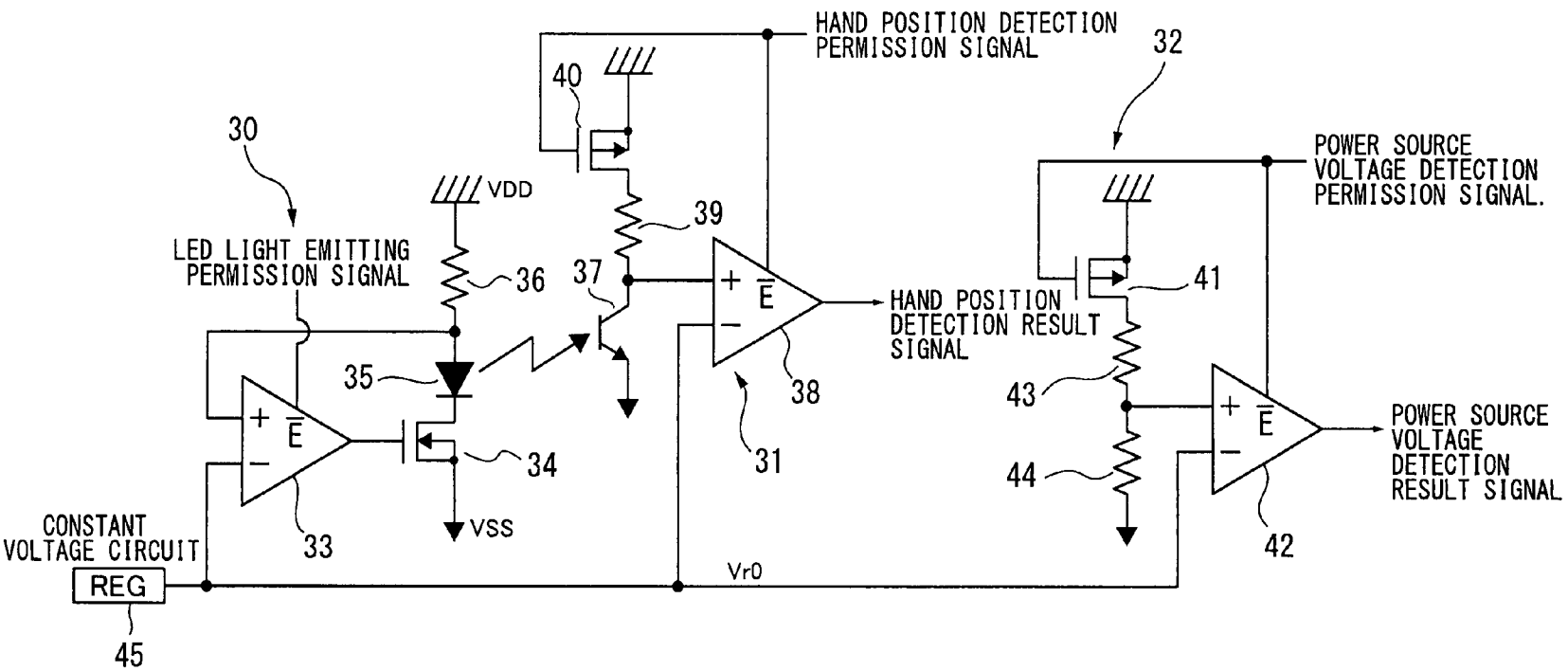
FIG. 17 is a block diagram showing a configuration of a transparent type hand position detection sensor of an analog electronic watch of Embodiment 11 of the invention.

In the above-described embodiments, the transparent type hand position detection sensor is provided as the hand position detection means 5. As shown in FIG. 17, this transparent type hand position detection sensor includes a light emitting unit 30, a light receiving unit 31, and a power source voltage detector 32.

The light emitting unit 30 includes a first comparator 33, a transistor 34, an LED 35 as a light emitting device, and a resistor 36. The light receiving unit 31 includes a phototransistor 37 as a light receiving device, a second comparator 38, a resistor 39, and a transistor 40. The power source voltage detector 32 includes a transistor 41, a third comparator 42, and resistors 43, 44.

In addition, a constant-voltage circuit 45 is electrically connected to the first comparator 33 of the light emitting unit 30, the second comparator 38 of the light receiving unit 31, and the third comparator 42 of the power source voltage detector 32, and is configured to apply a reference voltage Vr0 as a common reference voltage to the first comparator 33 of the light emitting unit 30 and the second comparator 38 of the light receiving unit 31.

The first comparator 33 of the light emitting unit 30 controls an electric current in the LED 35 so that it is in a constant electric current. The second comparator 38 of the light receiving unit 31 compares with a detection signal by the phototransistor 37 and outputs a hand position detection result signal. In addition, the third comparator 42 of the power source voltage detector 32 outputs a power source voltage result signal.

The transparent type hand position detection sensor is configured so that the first comparator 33 of the light emitting unit 30, the second comparator 38 of the light receiving unit 31, and the third comparator 42 of the power source voltage detector 32 operate only when receiving an LED light emission permission signal, a hand position detection permission signal, and a power source voltage detection permission signal, respectively. Thus, power consumption can be reduced. Alternatively, to reduce power consumption, the transparent type hand position detection sensor may be configured to operate only when the LED light emission permission signal, the hand position detection permission signal, and the power source voltage detection permission signal are outputted to the constant-voltage circuit 45. Further, the light emitting time of the LED 35 and the detection time (light receiving time) of the phototransistor 37 can be adjusted in accordance with the output time of the LED light emission permission signal and the hand position detection permission signal, respectively.

In addition, a movable member (not shown) including a detection hole is provided between the LED 35 and the phototransistor 37 so as to be movable in conjunction with the rotation of the hand (second hand 2*c*). When a light beam (transmission light) which is emitted from the LED at the time of hand position detection passes through the detection hole formed in the movable member and is detected (received) by the phototransistor 37, an electric current flows into the phototransistor 37. Thus, a hand position detection result signal is outputted from the second comparator 38, so that the position of the hand (second hand 2*c*) is detected.

Further, at the time of hand position detection operation, the LED light emission permission signal, the hand position detection permission signal, and the power source voltage detection permission signal are outputted, so as to turn the transistor 34 on. Then, the first comparator 33 causes a constant electric current to flow in the LED 35 to cause the LED 35 to emit light.

At this time, there is a case where when the power source voltage fluctuates because of a heavy load, a temperature change, and the like, so that the value of the reference voltage Vr0 of the constant-voltage circuit 45 becomes small. Then, the electric current flowing in the LED is reduced to a lower value than that at a normal time, so that emitted light from the LED 35 becomes dark. In such a case, in this embodiment, since the common reference voltage Vr0 is applied to the first comparator 33 of the light emitting unit 30 and the second comparator 38 of the light receiving unit 31, a detection threshold of the phototransistor 37 is also reduced depending on a reduction of the electric current flowing in the LED 35.

Thus, even when emitted light from the LED 35 becomes dark, the detection threshold of the phototransistor 37 is accordingly reduced to increase the detection sensitivity. As a consequence, the phototransistor 37 can perform stable detection (light receiving) of a light of the LED 35 just as in the normal time.

In contrast, there is also a case where when the power source voltage fluctuates because of a heavy load, a temperature change, and the like, the value of the reference voltage Vr0 of the constant-voltage circuit 45 becomes large. Then, the electric current flowing in the LED is increased to a value higher than that at a normal time, so that emitted light from the LED 35 becomes dark. In such a case, in this embodiment, since the common reference voltage Vr0 is applied to the first comparator 33 of the light emitting unit 30 and the second comparator 38 of the light receiving unit 31, a detection threshold of the phototransistor 37 is also increased depending on an increase of the electric current flowing in the LED 35.

Thus, even when emitted light from the LED 35 becomes bright, the detection threshold of the phototransistor 37 is accordingly increased to decrease the detection sensitivity. As a consequence, the phototransistor 37 can perform stable detection (light receiving) of a light of the LED 35 just as in the normal time.

As just described, according to this embodiment, the common reference voltage Vr0 of the constant-voltage circuit 45 is applied to the first comparator 33 of the light emitting unit 30 and the second comparator 38 of the light receiving unit 31. Accordingly, even when the power source voltage fluctuates because of a heavy load, a temperature change, and the like, so as to change the brightness of emitted light of the LED 35, the detection threshold of the phototransistor 37 can accordingly be changed. As a consequence, the phototransistor 37 can always detect (receive) the light of the LED 35 stably.

INDUSTRIAL APPLICABILITY

The invention is applicable to a digital camera, a digital video camera, a game machine, a mobile-phone, a PDA, a personal computer, a household electrical appliance, or the like that incorporates an analog electronic watch capable of, even when displayed time (the position of a hand) is displaced due to a shock, an external magnetism, or the like, detecting a position displacement of the hand.

The invention claimed is:

1. An analog electronic watch including: a display device for displaying time with a position of a hand being driven; a hand drive device for driving the hand; a hand drive device control unit for controlling driving of the hand drive device at a predetermined hand drive cycle in a normal state; a hand position detection device for detecting a position of the hand; and a hand position detection device control unit for intermittently controlling driving of the hand position detection device at a first detection cycle longer than the hand drive cycle, the analog electronic watch comprising a detection cycle changing device for instructing the hand position detection device control unit to change a detection cycle of the hand position detection device, wherein upon detection of a predetermined detection cycle changing condition, the detection cycle changing device changes a cycle at which the hand position detection device detects a position of the hand, from the first detection cycle to a second detection cycle, while maintaining the hand drive cycle in which the hand drive device drives the hand.

2. The analog electronic watch according to claim 1, wherein the second detection cycle is shorter than the first detection cycle.

3. The analog electronic watch according to claim 1, wherein the second detection cycle is the same as the hand drive cycle.

4. The analog electronic watch according to claim 3, further comprising:

a counter for counting every time the hand drive device drives the hand, the counter being operable to be reset each performing of a hand position detection before the detection cycle is changed to the second detection cycle, and operable to continue counting until a hand position is successfully detected after the detection cycle is changed from the first detection cycle to the second detection cycle; and a hand position correction amount calculation device for calculating a difference between the first detection cycle and a count value of the counter at the time when a hand position is successfully detected after the detection cycle is changed from the first detection cycle to the second detection cycle, for determining a correction condition of a hand position, based on the difference thus calculated, and for notifying the hand drive device control unit of the correction condition.

5. The analog electronic watch according to claim 4, further comprising a hand position displacement factor detection device for detecting a factor causing a hand position displacement in which a position of the hand and a time measured by an internal time timing device do not match with each other, and for outputting a detection signal to the detection cycle changing device when detecting a factor causing a hand position displacement, wherein the detection signal is the detection cycle changing condition.

6. The analog electronic watch according claim 5, wherein the hand drive device is operable to drive the hand at a cycle faster than the hand drive cycle in either of the forward and reverse directions of the hand, and the hand drive device control unit is operable to perform a correction of the hand position by driving the hand in either of forward and reverse hand directions at the faster cycle.

7. The analog electronic watch according to claim 6, wherein the detection cycle changing device is operable to change the detection cycle from the second detection cycle back to the first detection cycle in response to a correction termination instruction from the hand drive device control unit.

8. The analog electronic watch according to claim 7, wherein the hand is a second hand, and the first detection cycle is 60 seconds.

9. The analog electronic watch according to claim 5, wherein the hand position displacement factor detection device is a shock detection device which, upon detection of a shock, is operable to output a shock detection signal to the detection cycle changing device.

10. The analog electronic watch according to claim 9, wherein the hand drive device is a stepper motor, and the shock detection device is operable to output a shock detection signal to the detection cycle changing device upon detection of a counter-electromotive force generated in the stepper motor due to a shock externally applied.

11. The analog electronic watch according to claim 5, wherein the hand position displacement factor detection device is an external magnetism detection device for detecting magnetism externally applied, and for outputting a magnetism detection signal to the detection cycle changing device when detecting the magnetism.

12. The analog electronic watch according to claim 11, wherein the hand drive device is a stepper motor, the hand position displacement factor detection device is a stepper motor rotation detection device for detecting whether the stepper motor is in rotation or not, by detecting a magnetic field generated due to the rotation of the rotor of the stepper motor, and the stepper motor rotation detection device also functions as the external magnetism detection device by detecting a magnetic field generated in the stepper motor at the time of generation of external magnetism.

13. The analog electronic watch according to claim 5, wherein the hand position displacement factor detection device is a temperature detection device for detecting ambient temperature, and for outputting a temperature detection signal to the detection cycle changing device when detecting the ambient temperature.

14. The analog electronic watch according to claim 5, wherein the hand position displacement factor detection device is a light detection device for detecting ambient brightness, and for outputting a light detection signal to the detection cycle changing device when detecting the ambient brightness.

15. The analog electronic watch according to claim 14, wherein a power source as a source of power includes a photoelectric conversion device and a power storage device storing electric power generated by the photoelectric conversion device, and the light detection device is operable to detect the brightness of light received by the photoelectric conversion device.

16. The analog electronic watch according to claim 5, wherein the hand position displacement factor detection device is a power source voltage detection device which detects a power source voltage of a power source as a source of power, and when the value of the power source voltage detected by the power source voltage detection device is equal to or higher than a predetermined voltage, a high voltage detection signal is outputted to the detection cycle changing device.

17. The analog electronic watch according to claim 5, wherein the hand position displacement factor detection device is a pressure detection device for detecting pressure applied on the analog electronic watch, and when the value of the pressure detected by the pressure detection device is equal to or higher than predetermined pressure, a high pressure detection signal is outputted to the detection cycle changing device.

18. The analog electronic watch according to claim 5, wherein the hand drive device is a stepper motor, the hand position displacement factor detection device is a stepper motor rotation detection device for detecting whether the stepper motor is in rotation or not, and which includes a counter counting when the stepper motor is determined not to be in rotation, and when a count value of the counter is equal to or higher than a predetermined value, a detection signal is outputted to the detection cycle changing device.

19. The analog electronic watch according to claim 5, comprising, as the hand position displacement factor detection device, an external operation member, and an operation signal output which outputs an operation signal to the detection cycle changing device when the external operation member is operated.

20. The analog electronic watch according to claim 5, wherein the detection cycle changing condition is a failure of a hand position detection performed before the detection cycle is changed from the first detection cycle to the second detection cycle.

* * * * *